US006622821B2

(12) United States Patent
Butler

(10) Patent No.: US 6,622,821 B2
(45) Date of Patent: Sep. 23, 2003

(54) THIN ACOUSTIC MUFFLER EXHAUST PIPES, METHOD OF SHEET METAL CONSTRUCTION THEREOF, AND EXHAUST SYSTEMS WHICH UTILIZE SUCH EXHAUST PIPES FOR INCREASED GROUND CLEARANCE ON RACE CARS

(76) Inventor: Boyd L. Butler, 1672 E. 10770 South, Sandy, UT (US) 84093

( * ) Notice: Subject to any disclaimer, the term of this patent is extended or adjusted under 35 U.S.C. 154(b) by 0 days.

(21) Appl. No.: 09/943,819

(22) Filed: Aug. 31, 2001

(65) Prior Publication Data

US 2003/0042071 A1 Mar. 6, 2003

(51) Int. Cl.[7] ..... F01N 1/08

(52) U.S. Cl. ..... 181/270; 181/268; 181/269; 181/270; 181/271; 181/272; 138/109; 138/177; 138/128

(58) Field of Search ..... 181/270, 272, 181/271, 269, 268; 138/177, 178, 109

(56) References Cited

U.S. PATENT DOCUMENTS

| | | | | |
|---|---|---|---|---|
| 981,584 A | | 1/1911 | Miller | |
| 1,002,801 A | | 9/1911 | Boeck | |
| 1,697,839 A | * | 1/1929 | Goerlich | 181/269 |
| 4,114,715 A | | 9/1978 | Theron | |
| 4,125,171 A | | 11/1978 | Morris | |
| 5,152,366 A | | 10/1992 | Reitz | |
| 5,269,650 A | | 12/1993 | Benson | |
| 5,304,749 A | | 4/1994 | Crandell | |
| 5,824,972 A | * | 10/1998 | Butler | 181/279 |
| 5,868,172 A | | 2/1999 | Graves | |
| 5,992,470 A | | 11/1999 | Redman | |
| 6,009,914 A | | 1/2000 | Castano | |
| 6,283,162 B1 | | 9/2001 | Butler | |
| 6,308,799 B1 | * | 10/2001 | Konstantakopoulos | 181/282 |

FOREIGN PATENT DOCUMENTS

| | | |
|---|---|---|
| FR | 667215 | 10/1929 |

* cited by examiner

*Primary Examiner*—Bentsu Ro
*Assistant Examiner*—Renata McCloud
(74) *Attorney, Agent, or Firm*—Mallinckrodt & Mallinckrodt; Robert R. Mallinckrodt

(57) ABSTRACT

A flattened acoustic muffler for use on stock cars. The muffler mounts to the standard exhaust system pipes and to the lower chassis of the car, routing exhaust gasses to one or both sides of the car while providing improved ground clearance between the exhaust pipe and the surface of the race track. The muffler contains a plurality of spiral acoustic traps, which attenuate exhaust noise while producing little additional backpressure.

45 Claims, 7 Drawing Sheets

Figures 1, 3, 4:
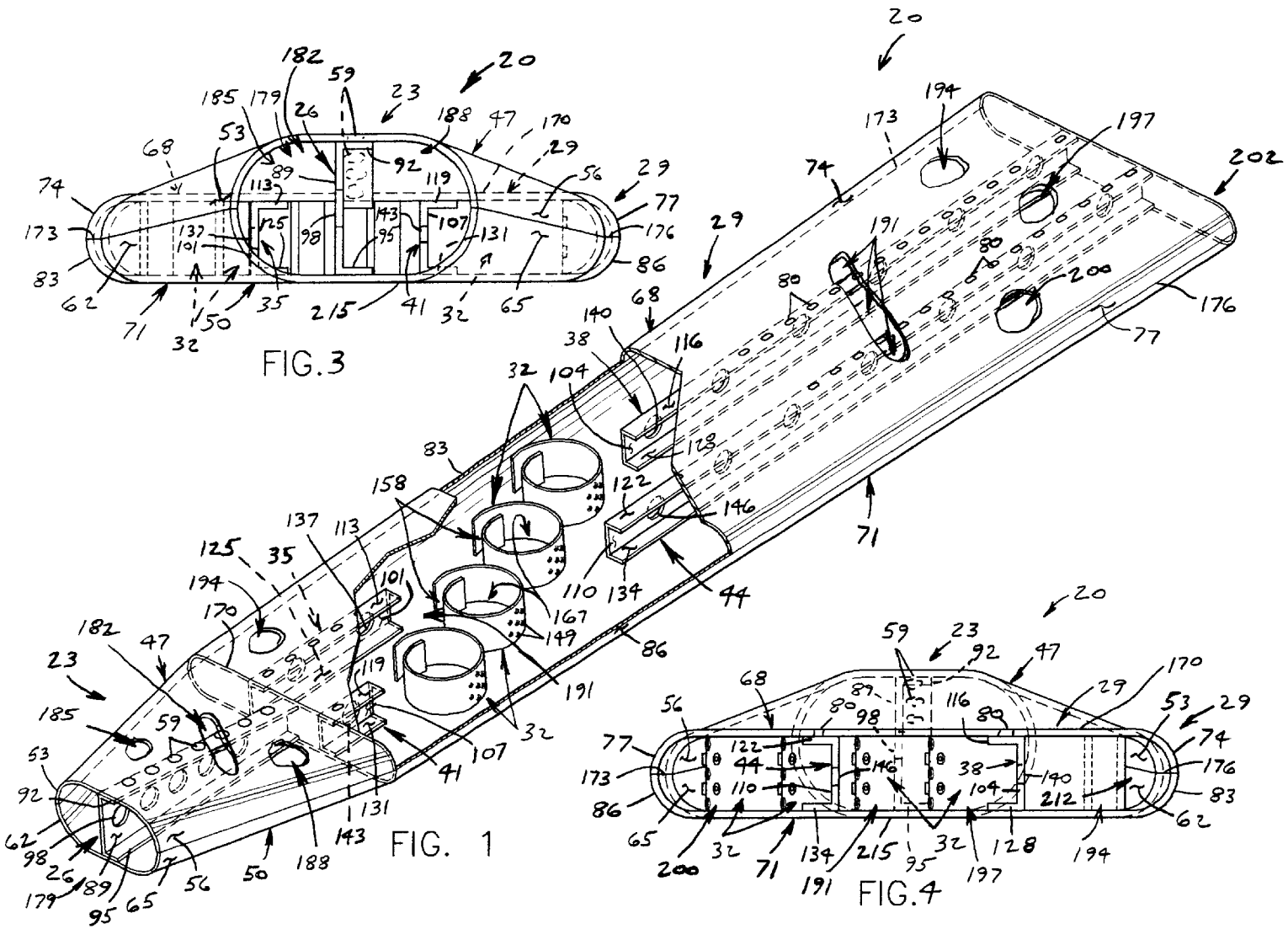

THIN ACOUSTIC MUFFLER EXHAUST PIPES, METHOD OF SHEET METAL CONSTRUCTION THEREOF, AND EXHAUST SYSTEMS WHICH UTILIZE SUCH EXHAUST PIPES FOR INCREASED GROUND CLEARANCE ON RACE CARS

BACKGROUND OF THE INVENTION

1. Field

The invention is in the field of acoustic mufflers and exhaust systems for automobiles, and more specifically mufflers for reducing acoustic noise produced by race cars while minimizing the reduction of engine performance due to increased exhaust gas backpressure, and thin exhaust pipes for increased ground clearance on race cars used on oval tracks such as stock cars.

2. State of the Art

Race cars used in automobile racing are typically constructed such that only a minimal amount of clearance is maintained between the underside of the car and the surface of the roadway or track. This is done to lower the center of gravity of the vehicle so as to improve vehicle handling and resistance to rolling over, and to minimize the drag on the car due to air passing thereunder. Likewise, such race cars typically have very stiff suspension systems which do not allow the vehicle to travel as great a distance up and down nor side-to-side as a standard production car allowing the use of less ground clearance. One of the problems encountered in lowering the race car closer to the race track is providing sufficient clearance for the vehicle exhaust system which is one of the lowest hanging components of a typical car, including race cars.

The problem is particularly acute on cars which race on oval race tracks such as stock cars. The exhaust pipes of such stock cars typically exit toward one or both sides of the car so as to minimize the length of the exhaust pipes and the resulting exhaust gas back pressure which back pressure lowers engine power output and overall engine performance. As such, the minimum ground clearance of the exhaust system typically occurs where the exhaust pipes cross under the longitudinally-extending main frame members of the chassis at the sides of the vehicle. Stock cars typically race on oval tracks in a counter-clockwise rotational direction with centrifugal force causing the body and chassis of the car to lean toward the outside of the turn or toward the right side of the car. Therefore, the ground clearance on the right side of the car is less during cornering and the greatest ground clearance results on the left side of the car during such cornering. Also, banked tracks can induce high downward loads to the suspension system of stock cars requiring additional ground clearance. In an effort to increase the ground clearance of the exhaust system on stock cars, thin profile boom tube exhaust pipes were developed which extend at a rearward, laterally outwardly-directed angle from the secondary exhaust pipes under the main frame members of the chassis. The outlet end of such boom tube exhaust pipe is typically manufactured in a squared-off or right angle end configuration and trimmed at installation to match exit angle and the side of the particular vehicle.

The construction of prior art boom tube exhaust pipes typically takes several forms. A first type of prior art boom tube includes a thin profile, generally flattened sheet metal body having a pair of spaced, parallel flat upper and lower sheet metal pieces and a pair of elongate, U-shaped cross-section sheet metal side pieces welded to respective side edges of the upper and lower sheet metal pieces so as to form a generally flattened tubular body. The upper and lower sheet metal pieces can be tapered so as to form a laterally tapered body which allows the exhaust gasses to expand while traveling therethrough. The upper and lower sheet metal pieces are typically interconnected by a plurality of short rods welded into staggered mating holes in such upper and lower sheet metal pieces. The rods are an attempt to minimize vibration of the broad upper and lower half shells which vibration can cause increased exhaust gas back pressure, resonance and increased noise, and metal fatigue. The boom tube exhaust pipe further includes a single funnel shaped inlet or a pair thereof which is welded to one end of the generally flattened tubular body to connect with the secondary exhaust pipe or pipes of the vehicle. Such inlets typically comprise a longitudinally split thin walled metal tube, the respective halves of which are partially flattened, more so at one end than the other end, and each longitudinally welded at the edges thereof to a pair of upper and lower tapered flat plates, the narrower edge thereof being adjacent the less-flattened ends of the respective half tubes so as to form a generally funnel shaped inlet with a somewhat flattened circular inlet end and a generally flattened profile outlet end. Alternatively, such inlets can comprise a thin walled metal tube into the respective ends of which are forced appropriately shaped arbors or forms which stretch and form the tube into a somewhat flattened circular shaped inlet end and a generally flattened profile outlet end. Such boom tube exhaust pipe is expensive to manufacture due to the multitude of rods and welding involved and is still prone to metal fatigue due to the increased stresses in the half shells at the respective holes therethrough and due to the increased brittleness of the metal of the half shells and rods due to the heat applied during welding thereof.

A second type of prior art boom tube exhaust pipe comprises a large diameter, thin walled steel tube which is generally flattened so as to form a thin profile, generally flattened tubular body. The upper and lower portions of the tubular body can be interconnected by a plurality of rods as explained for the first version prior art boom tube exhaust pipe. A single funnel shaped inlet or a pair thereof of similar construction as that of the first version prior art boom tube is welded to one end of the flattened tubular body to connect with the secondary exhaust pipe or pipes of the vehicle. The tubular body of such boom tube exhaust pipe does not taper outwardly from the inlet end to the outlet end due to fabrication from a tube such that exhaust gasses cannot expand while moving therethrough, causing increased exhaust gas back pressure and suffers from the same disadvantages as the first version prior art boom tube exhaust pipe.

A third type of prior art boom tube takes the form of a rectangular extruded steel tube to which a pair of elongate U-shaped cross-section sheet metal side pieces are welded to the sides thereof to form a thin profile, generally flattened tubular body having three elongate passageways therein. A plurality of exhaust crossover holes are typically drilled or milled through the walls of the tube to allow crossover flow of exhaust gasses between the elongate passageways. A single funnel shaped inlet or a pair thereof of similar construction as that of the first version prior art boom tube is welded to one end of the flattened tubular body to connect the secondary exhaust pipe or pipes of the vehicle to direct the exhaust gasses into the ends of the respective tubes. A plurality of such rectangular tubes (or square tubes) can be welded together side-by-side in place of the single rectangular tube with the sheet metal side pieces welded to the two outermost tubes to form a thin profile, generally flattened tubular body of greater width than using a single rectangular tube. A plurality of exhaust crossover holes are typically drilled or milled through the walls of the tubes to allow crossover flow of exhaust gasses between the elongate passageways. A single funnel shaped inlet or a pair thereof is welded to one end of the flattened tubular body to connect the secondary exhaust pipe or pipes of the vehicle to direct the exhaust gasses into the ends of the respective tubes. While such boom tube exhaust pipe is more fatigue resistant than the sheet metal, the weight thereof is greater, the exhaust gas crossover tubes must typically be drilled or milled rather than less expensive punching thereof, and the body is not tapered such that exhaust gasses cannot expand while traveling therethrough, resulting in increased exhaust gas back pressure.

Such prior art boom tube exhaust pipes can be constructed such that the inlet is at or above a lower plane of the body thereof so as to maximize ground clearance. Likewise, exhaust systems comprising a pair of headers each including a plurality of primary exhaust pipes which connect at one end thereof to the cylinder block of an internal combustion engine at respective exhaust outlet ports thereof and at opposite ends thereof which converge into a single merge collector, a pair of secondary exhaust pipes which connect to the outlet of the respective merge collectors, and one or two boom tube exhaust pipes are used in auto racing. Such exhaust systems can be made and mounted to a race car such that the entire exhaust system, including the inlets of the boom tube exhaust pipes, are at or above the lower plane of the bodies of the boom tube exhaust pipes to maximize ground clearance of the exhaust system.

Such prior art boom tube exhaust pipes are not specifically designed to act as acoustic mufflers and are therefore not effective at reducing acoustic noise. This may be because any baffles or other such device used in prior art mufflers other than that disclosed in my U.S. Pat. No. 5,824,972 tend to decrease engine horsepower and torque to unacceptably low levels due to the increase in engine exhaust gas back-pressure caused by such devices.

There are basically two types of prior art acoustic mufflers which have been used, but applicant is not aware of any such acoustic mufflers being combined with a boom tube exhaust pipe. The two types are friction mufflers which mix the gas flow to break up the sound waves, and absorption mufflers which absorb the sound waves in an acoustic damping material.

The friction type muffler is used most frequently, particularly on automobiles. This type of muffler has a casing with an inlet and outlet which can be positioned in a variety of locations, and a series of baffle plates therebetween to direct the gas flow in a circuitous route from inlet to outlet to cause mixing of the gas flow. Offset perforated inlet and outlet pipes may each extend the length of the casing to provide the circuitous route. Friction type mufflers are generally quite effective at reducing noise levels, but because of the circuitous route followed by the exhaust gases passing through the muffler, offer substantial resistance to gas flow. Therefore, significant pressure is required to force the gases through the muffler. This pressure, referred to as back pressure, reduces the efficiency and power output of the engine being muffled.

The absorption type muffler has a casing with a pipe extending completely therethrough. A portion of the pipe inside the casing is perforated and the space between the pipe and casing is filled with sound absorbing fiberglass, ceramic fibers, or metallic wool mesh to absorb sound waves. By allowing the exhaust gases to pass directly through the muffler, the pressure required to push the gas through the muffler is significantly reduced. Therefore, the back pressure is much less than with friction type mufflers and more power is obtained from the engine. However, the sound attenuation is much less than with friction mufflers, and such mufflers are unacceptable in most uses.

Muffler acoustic efficiency is measured in decibels of noise attenuation (dba) versus gas flow in cubic feet per minute (CFM). When a pressure difference of 5 inches of water is imposed between the inlet and outlet, and using a common 2½ inch diameter muffler inlet and outlet, friction type mufflers have about 13–20 dba attenuation and 70–100 CFM flow. Absorption type straight through mufflers under those conditions have an attenuation of about 2–7 dba and 200 CFM flow.

There is a need in many applications for a muffler which has greater acoustic attenuation than the absorption type muffler with higher flow rates and less back pressure than the friction type mufflers.

In my U.S. Pat. No. 5,824,972 is disclosed an acoustic muffler which provides superior acoustic attenuation with minimal increase in exhaust gas backpressure. The acoustic muffler comprises a conventional sheet metal casing which has an inlet and an outlet at opposite ends thereof. A flow of gas containing acoustic noise flows from inlet to outlet. A plurality of spiral acoustic traps, each of which extend from bottom to top of the casing, have a central axis positioned perpendicular to the gas flow. An opening in each spiral acoustic trap extends into the gas flow to divert some gas into the trap, wherein the gas flows in a circular path so as to degrade and randomize the sound waves into heat, by utilizing a circular mixing process with increased gas retention time. Gas is drawn out of the acoustic trap through a series of vent holes in the acoustic trap on the back side of the acoustic trap opposite the opening, by utilizing a venturi effect created by part of the inlet gas flow which is split off into a peripheral gas flow to flow around the acoustic trap through a constricted area just ahead of the vent holes, created by the acoustic trap and the adjacent casing wall or adjacent trap, so as to create a low pressure zone at the vent holes to continuously draw gas out of the acoustic trap. The acoustic traps may be oriented in a single or multiple linearly extending staggered groups, with in-line or offset inlets and outlets.

In this regard, my previously issued U.S. Pat. No. 5,824,972 issued to me Oct. 20, 1998 titled "Acoustic Muffler", and my U.S. patent application Ser. No. 09/393,398 titled "Thin Boom Tube Exhaust Pipes, Method of Sheet Metal Construction Thereof, and Exhaust Systems Which Utilize Such Exhaust Pipes For Increased Ground Clearance On Race Cars," now U.S. Pat. No. 6,283,162, are hereby incorporated by reference into this patent application.

SUMMARY OF THE INVENTION

The invention comprises a flattened profile acoustic muffler exhaust pipe, or acoustic muffler boom tube exhaust pipe for attachment to the end of a secondary exhaust pipe or exhaust pipe header assembly leading exhaust gasses away from the engine of a motor vehicle. The boom tube exhaust pipe mounts to the bottom portion of the frame or chassis of the motor vehicle typically adjacent the side of the vehicle and provides improved ground clearance between the exhaust pipe and the surface of the ground. The exhaust pipe includes one or more spiral acoustic traps utilizing a circular mixing process with increased gas retention time to attenuate acoustic noise more effectively than an absorption muffler and with substantially less back pressure than friction mufflers.

The boom tube exhaust pipe is of generally tubular configuration, comprising a tubular inlet having a first end of mating configuration for attachment to a secondary exhaust pipe or to an exhaust pipe header assembly, having an inlet opening for receiving exhaust gasses therefrom of generally circular or slightly flattened circular shape with the secondary exhaust pipe or exhaust pipe header assembly having a mating shape, the tubular inlet tapering from the first end to a second, thin profile, generally flattened end, a tubular body of generally flattened shape corresponding to the second end of the tubular inlet, which tubular body extends therefrom and which terminates at an outlet opening for expelling the exhaust gasses into the atmosphere, and one or more spiral acoustic traps strategically placed inside the tubular body. The spiral shaped acoustic traps provide circular mixing of a main gas flow combined with a venturi effect created around the traps by a peripheral gas flow which draws the gas from the acoustic traps through outlet vents in the acoustic traps provides effective acoustic muffling while achieving high flow rates with minimal back pressure.

Each spiral acoustic trap comprises a single, preferably thin wall, which is loosely wrapped about a central axis and which wall spans between opposing casing top and bottom walls. The spaced ends of the acoustic trap define an entrance opening through which gas can enter into an inner chamber formed by the acoustic trap wall, and opposing top and bottom casing walls. A series of vent holes extend through the acoustic trap wall in an appropriate location away from the opening to allow gas flow from the inner chamber.

When inlet gas flows through the casing inlet it is split into one or more main gas flows and one or more smaller peripheral gas flows, each of which flow in the general direction of an outlet in the casing. The main gas flow moves on the open side of each acoustic trap, i.e., the side with entrance opening, with the central axis of each trap extending substantially perpendicular to the main gas flow, and the entrance opening of each trap located in the main gas flow so as to divert a portion of the main gas flow into the inner chamber. The diverted gas forms an inner chamber gas flow which travels in a continuous circular mixing motion so as to break up the sound waves into random molecular motion, adding heat energy to the gas.

The peripheral gas flow travels on the opposite side, or back side of the spiral acoustic traps from the entrance opening. The volume and rate of peripheral gas flow may be set by a perforated metering screen, a metering plate, or other appropriate restriction, which partially or completely covers the opening between the backside of the first trap of each group, the side wall, and opposing casing top and bottom walls. The back side of each trap, along with the casing side wall or other acoustic traps, form a venturi through which the peripheral gas flow is accelerated to form a low pressure zone. A series of vents or outlets through each acoustic trap wall may be present between the inner chamber gas flow and the low pressure zone to draw gas from the inner chamber, in the form of a vent gas flow, into the peripheral gas flow to make room for more of the main gas flow to enter the inner chamber to join the inner chamber gas flow. While providing a vent or outlet through the trap wall enhances air flow through the trap to better absorb more of the acoustic energy such vents or outlets may not be absolutely required. Also, one or more vents or outlets may be present in the casing leading from the traps to the outside of the casing. In this configuration, a low pressure area or venturi effect may be present to assist in pulling gases from the traps.

The acoustic traps are generally placed in one linearly diagonally extending group of acoustic traps so as to maximize the uptake of the main gas flow yet minimize the increase in exhaust gas backpressure, with the spiral acoustic traps offset such as by about half a trap width, and with each successive trap overlapping the main gas flow further. Other configurations are possible including multiple linearly diagonally extending groups and the other configurations in my U.S. Pat. No. 5,824,972.

The tubular inlet is typically configured such that the bend radius of respective side portions of the tubular inlet typically decreases uniformly from the first to second end thereof unlike prior art inlets. The flattened tubular body can include a bottom surface lying generally in a plane with the bottom of the tubular inlet at or above the lower plane in a mounted position on the motor vehicle allowing all of the other pipes of the exhaust system lie at or above such plane so as to maximize ground clearance. The body can be flared laterally outwardly from the tubular inlet to the outlet opening so as to allow the exhaust gasses to expand while moving through the body yet without decreasing the ground clearance of the boom tube exhaust pipe.

A structural rib can extend generally longitudinally through the tubular inlet, which structural rib is tapered so as to span between and is affixed to the tubular inlet juxtaposed an upper and a lower inside surface of the tubular inlet, so as to provide support to the tubular inlet. Such structural rib can include a generally non-tapered portion which extends into the tubular body, which structural rib spans between and is also affixed to the tubular body juxtaposed an upper and a lower inside surface of the tubular body. One or more structural ribs can extend generally longitudinally through the tubular body, which structural ribs are typically split and longitudinally spaced so as to provide room for the diagonally disposed spiral acoustic traps, which structural ribs span between and are affixed to the tubular body juxtaposed an upper and a lower inside surface of the tubular body, so as to provide support to the tubular body. A plurality of holes can extend through the structural rib to allow exhaust gasses to flow between elongate passageways formed on each side of the structural ribs, the tubular inlet, and the body. The structural rib can comprise a web interconnecting respective upper and lower legs or flanges which extend laterally therefrom, such as in a C-shaped channel cross-section, which structural rib can be plug welded to the tubular inlet and the body through a plurality of holes such as round holes or slots through the tubular inlet and body.

The exhaust pipe can include a pair of tubular inlets of similar construction to the first and laterally adjacent for attachment to first and second secondary exhaust pipes. A structural rib can extend generally longitudinally through each tubular inlet, which structural ribs are tapered so as to span between and is affixed to the respective tubular inlet juxtaposed an upper and a lower inside surface of the respective tubular inlet, so as to provide support to the respective tubular inlet. Such structural ribs can each include a generally non-tapered portion which extends into the tubular body, which structural ribs span between and is also affixed to the tubular body juxtaposed an upper and a lower inside surface of the tubular body. One or more structural ribs can extend generally longitudinally through the tubular body, which structural ribs are typically split and longitudinally spaced so as to provide room for the diagonally disposed spiral acoustic traps, which structural ribs span between and are affixed to the tubular body juxtaposed an upper and a lower inside surface of the tubular body, so as to provide support to the tubular body. Such structural ribs typically include a center structural rib which extends generally longitudinally through the body generally laterally centered therein between the respective inlets and structural ribs thereof and a pair of structural ribs generally longitudinally aligned with such inlets and spaced from the structural ribs thereof. The structural ribs provide further support to the body, reducing vibration and resulting fatigue failure of the metal of the body. On the dual inlet versions, laterally adjacent portions of the inlets can be vertically cut so as to mate or merge together laterally and be welded at the periphery therebetween to place the inlets closer together.

The invention further comprises acoustic muffler exhaust pipes constructed from standard sheet metal which can be sheared, punched, and formed on standard hand operated punch presses and breaks or other comparable press to allow low cost, low volume production thereof as well as on high volume Computer Numerically Controlled (CNC) programmable punch presses and multiple station automated progressive stamping machines. The tubular inlet and body comprise a pair of sheet metal half shells which are welded together such as at respective peripheral seams. The half shells can comprise respective upper and lower half shells each of which can comprise inlet and body halves which are generally laterally welded together. The structural rib comprises a piece of sheet metal formed so as to have a longitudinally-extending web which interconnects respective laterally outwardly bent upper and lower legs or flanges which extend generally normally therefrom, such as forming a C-shaped channel cross-section. The portion of the structural rib which extends into the inlet is tapered so as to span between an upper and a lower inside surface of the inlet, such tapered portion being formed such as by splitting the upper and/or the lower leg or flange and forming at an angle relative to the remainder thereof. A plurality of punched holes can extend through the web of the structural rib to allow exhaust gasses to flow therethrough. The spacer ribs are constructed in a similar manner from sheet metal but without the tapered inlet portion. The structural ribs and spacer ribs can be plug welded to the half shells through a plurality of holes such as round holes or slots through the respective half shells. Single or dual inlet boom tube exhaust pipes can be made using such construction. On the dual inlet versions, laterally adjacent portions of the inlet halves of the upper and lower half shells can be vertically cut so as to mate or merge together laterally and be welded at the periphery between the inlet halves to place the inlets closer together.

The invention further comprises exhaust systems which include the acoustic muffler exhaust pipes of the invention, such exhaust systems being for use on motor vehicles powered by an internal combustion engine having multiple power cylinders. Such exhaust systems comprise a pair of exhaust pipe header assemblies each of which include a plurality of primary exhaust pipes each connectable at a first end thereof to the engine block at a respective power cylinder exhaust port and a merge collector into which respective opposite ends of the primary exhaust pipes converge and are welded, a pair of transition pipes each having a first end connectable to one of the merge collectors and each having a second end, and a single boom tube exhaust pipe having a pair of inlets, or a pair of acoustic muffler exhaust pipes each having a single inlet. The second ends of the transition pipes are connectable to the respective inlets of the single or dual inlet boom tube exhaust pipes. The single inlet version diverges to laterally opposite sides of the motor vehicle and the dual inlet version exits to one side of the motor vehicle.

The invention further comprises a method of construction of an acoustic muffler exhaust pipe from standard sheet metal, comprising the steps of providing a pair of upper and lower half shells of formed sheet metal which include an inlet portion, a body portion, and an outer periphery, providing a spiral acoustic trap formed of sheet metal, providing an elongate rib of formed sheet metal having a web which interconnects a pair of respective upper lower legs or flanges which extend laterally outwardly therefrom, placing the spiral acoustic trap and the rib generally longitudinally within the half shells, welding the spiral acoustic trap and the rib to the respective upper and lower half shells, and welding the outer peripheries of the half shells together. The method can be practiced wherein the welding of the spiral acoustic trap and the rib to the respective upper and lower half shells is of the resistance spot welding type, or by using half shells each of which include a plurality of longitudinally extending plug weld holes such as round holes or slots punched therethrough and plug welding the spiral acoustic trap and the rib to the respective upper and lower half shells through the plug weld holes. The half shells can comprise upper and lower half shells. Each of the upper and lower half shells can comprise separate inlet and body halves and the method further include welding the inlet and body halves of the respective upper and lower half shells together. The method can include construction of dual inlet boom tube exhaust pipes having a pair of structural ribs. The inlet halves of the upper and lower half shells can be made from separate pieces of sheet metal and can be vertically cut so as to mate or merge together laterally and the inner periphery between the inlets halves of the upper and lower half shells welded together. The method can include construction of a boom tube exhaust pipe having a center structural rib and/or a pair of structural ribs each disposed laterally outside one of the respective structural ribs in the inlets.

The single and dual inlet acoustic muffler exhaust pipes of the invention, exhaust systems which include such exhaust pipes, and the methods of construction thereof can include acoustic muffler exhaust pipes which are also acoustic mufflers, all of which this invention further comprises.

As such the tubular inlet or inlets and in particular the flattened tubular body of the boom tube exhaust pipe comprise the casing of the muffler and a plurality of spiral acoustic traps disposed therein provide the acoustic attenuation. The specific configurations of the combined boom tube exhaust pipe acoustic muffler include any of those disclosed in my prior "Acoustic Muffler" patent, with a single longitudinally diagonally disposed row of acoustic traps being preferred in both the single and the dual inlet versions of the boom tube exhaust pipe acoustic muffler. In such configuration as well as in the other configurations thereof, any such structural ribs and/or spacer ribs can include longitudinal gaps between which the spiral acoustic traps can extend. Such boom tube exhaust pipe acoustic mufflers can also include metering screens, deflectors such as a V-shaped inlet deflector, and perforated metering plates, or any other such components disclosed in my prior "Acoustic Muffler" patent. Such spiral acoustic traps can be affixed to the casing such as by fillet welding, plug welding, or resistance spot welding. The spiral acoustic traps can include one or more upper and lower locator tabs which are integral with or affixed to the spiral acoustic traps and which extend vertically upwardly and downwardly through corresponding generally rectangular or arcuate rectangular holes through the upper and lower walls of the casing or half shells. Such holes serve to locate and retain the spiral acoustic traps during assembly. Such tabs can be bent over upon assembly and are affixed to the casing such as by welding. Alternatively, such tabs can comprise bent ninety degree bent tabs integral with or separate pieces affixed to the spiral acoustic traps, which bent tabs fit juxtaposed the upper and lower surfaces of the casing, which tabs can be welded in a similar manner to the structural ribs, spacer ribs, and spiral acoustic traps. Such locating tabs and corresponding holes in the casing or half shells, and bent tabs can likewise be used on the metering screens, deflectors, perforated metering plates, and on any other such components used in the construction of the boom tube exhaust pipe acoustic muffler.

The boom tube exhaust pipe acoustic muffler can include other means for acoustic attenuation, such as a plurality of flat, curved, V-shaped, or otherwise bent baffle plates which route the exhaust gasses in a circuitous route therethrough so as to provide acoustic attenuation so as to lower the level of noise from the motor vehicle. Examples of such baffle arrangements in single and dual inlet versions include laterally extending, longitudinally spaced flat baffle plates which alternately extend from opposite sides of the casing with respective gaps between the free ends thereof and the opposite side portion of the casing for exhaust gasses to pass thereby so as to route the exhaust gases side-to-side in a generally horizontal plane. Such baffle plates can comprise laterally extending ribs of similar construction to the structural ribs and spacer ribs disclosed herein. The ends of the respective ribs which contact the side portions of the casing can be arcuate so as to match closely thereto without significant exhaust gas leakage therebetween. A second example of such baffle arrangement comprises a longitudinally extending series of alternating generally laterally disposed-V-shaped plates and pairs of flat plates, the V-shaped plates disposed generally along the longitudinal centerline of the casing pointing toward the tubular inlet with gaps between the respective ends thereof and the side portions of the casing to allow exhaust gasses to pass thereby. The flat plates extend from respective side portions of the casing in a generally coplanar fashion, with a gap between the free ends thereof at the longitudinal centerline of the casing to allow exhaust gasses to pass thereby. As such, the exhaust gasses are generally split into two streams which pass by opposite ends of each V-shaped baffle plate and remix in the gap between the flat plates.

Other such examples of such arrangements of baffle plates include such as for the dual inlet version a pair of such above examples, comprising two complete sets of baffle plates as described in the previous examples, one generally centered about the longitudinal centerline of each of the respective inlets, the innermost plates of which can terminate at the center spacer rib rather than the side portion of casing or simply terminate such that exhaust gasses can pass therearound.

THE DRAWINGS

Figure 2:
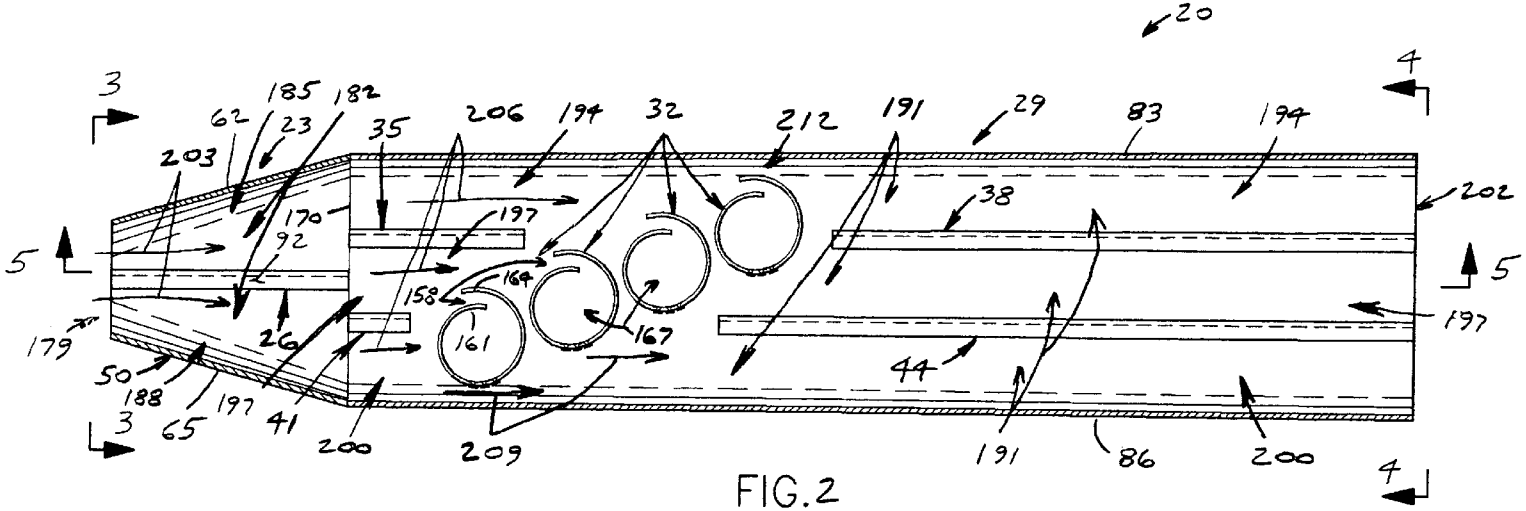
Figure 5A:
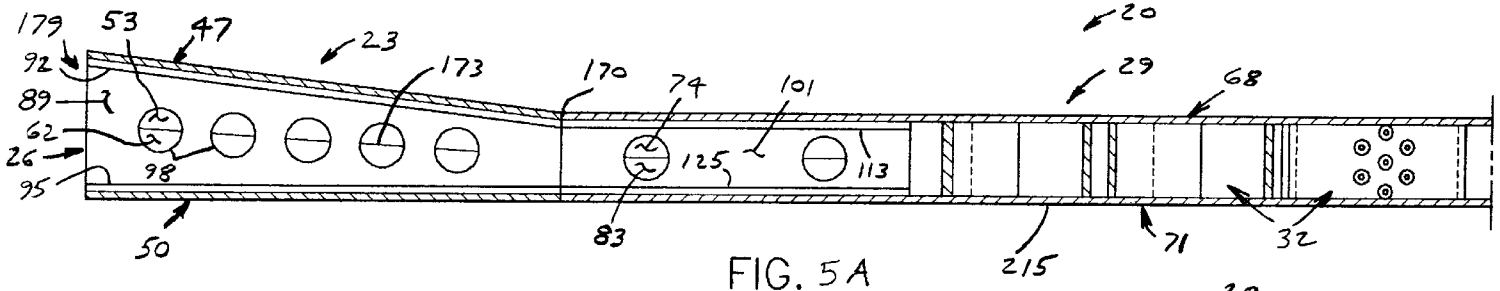
Figure 5B:
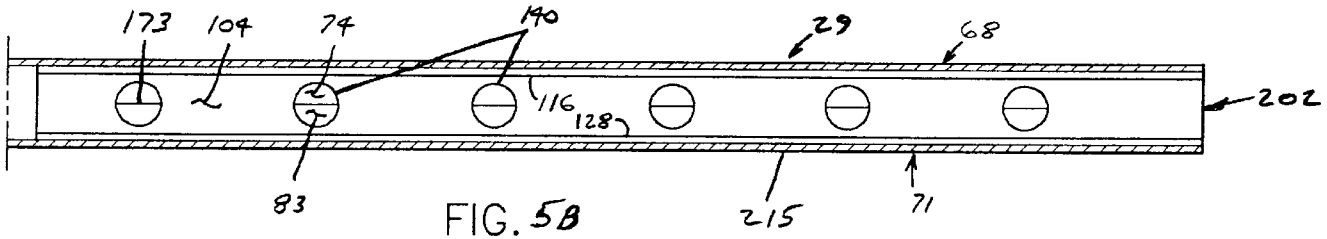
Figure 12:
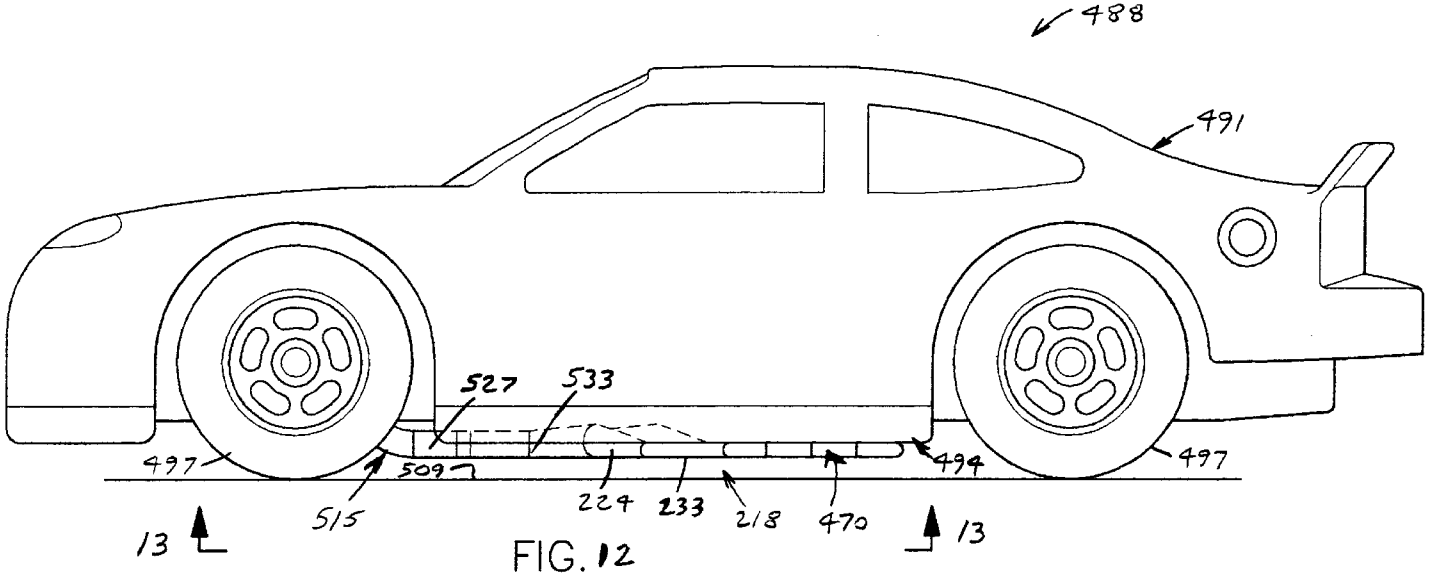
Figure 6:
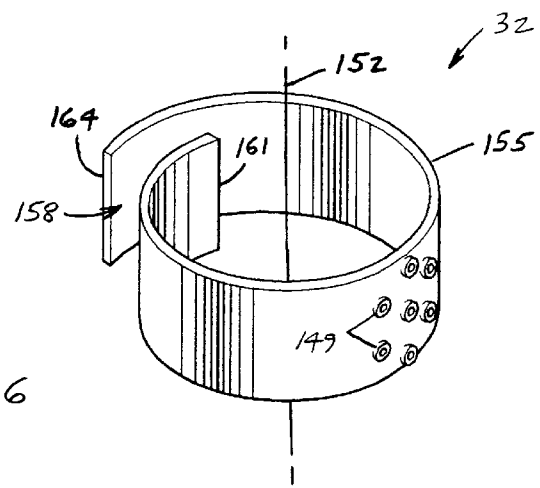
Figure 7:
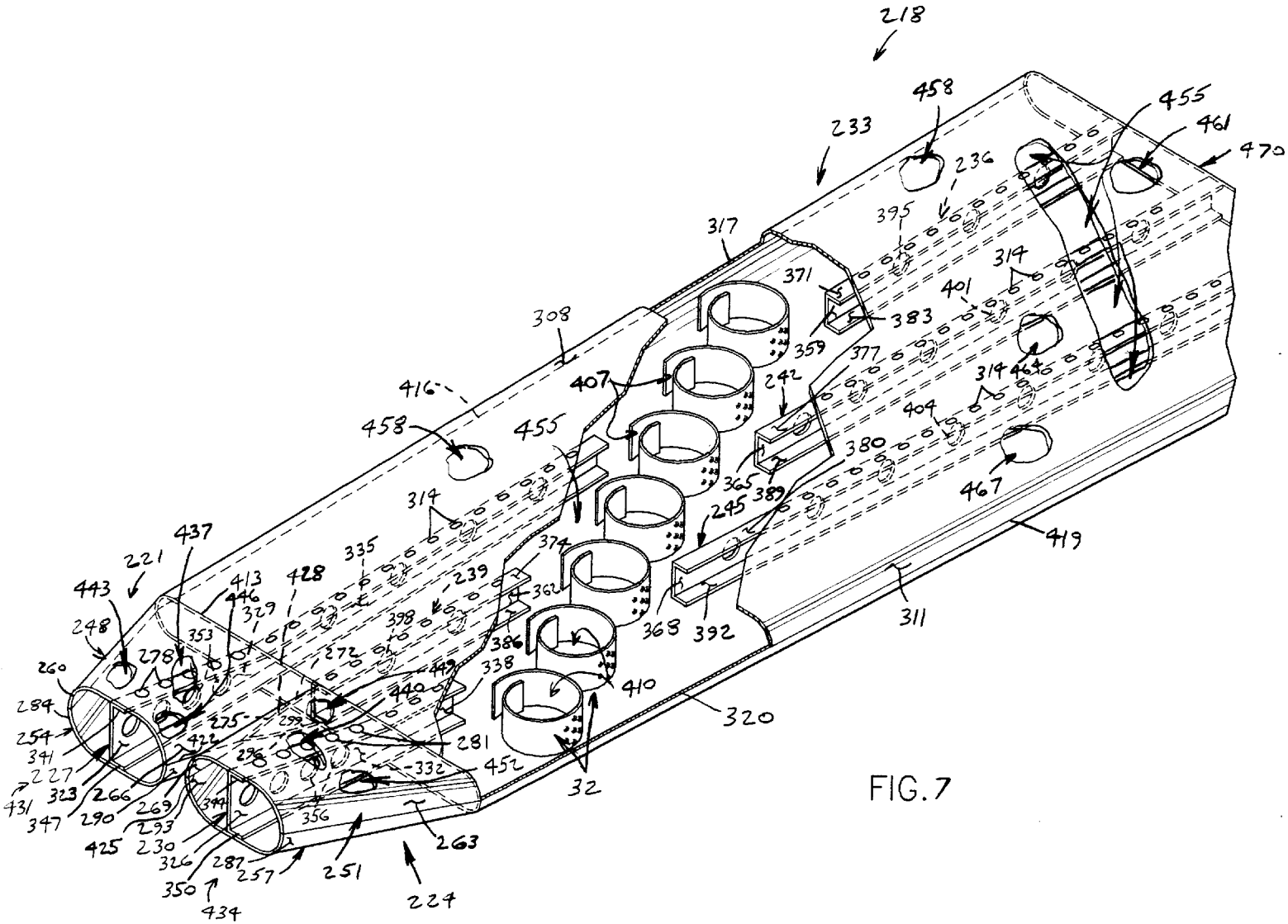
Figure 8:
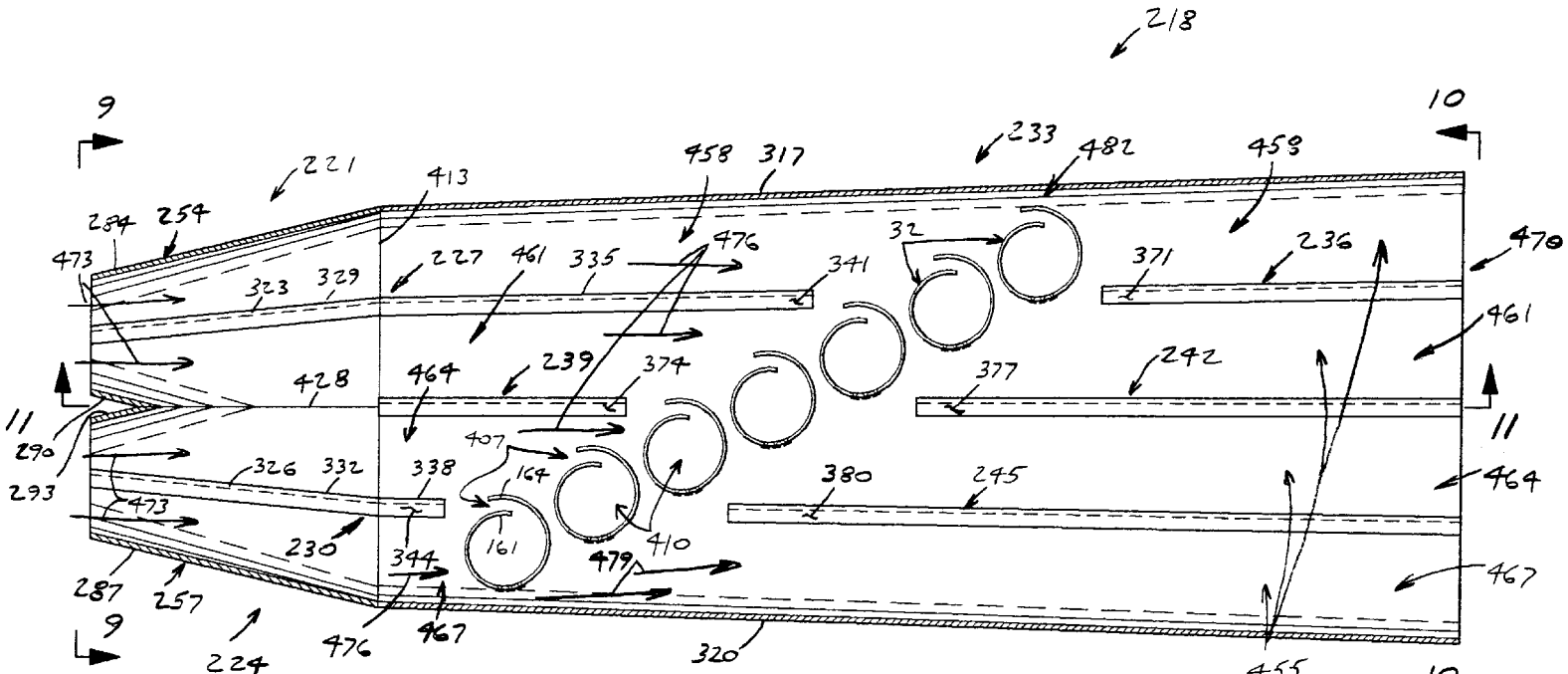
Figure 11A:
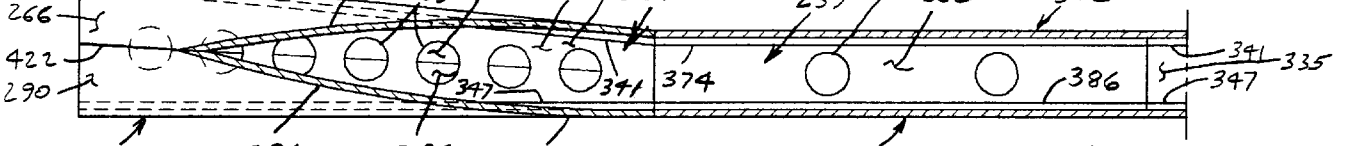
Figure 11B:
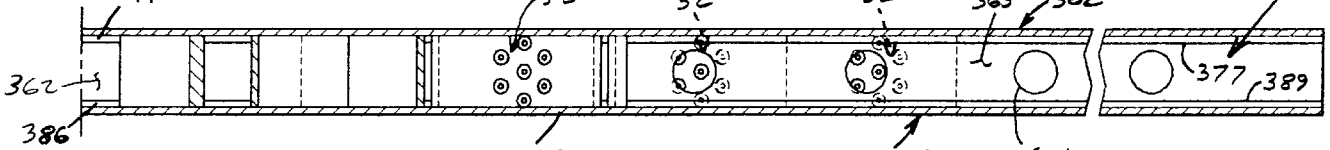
Figure 9:
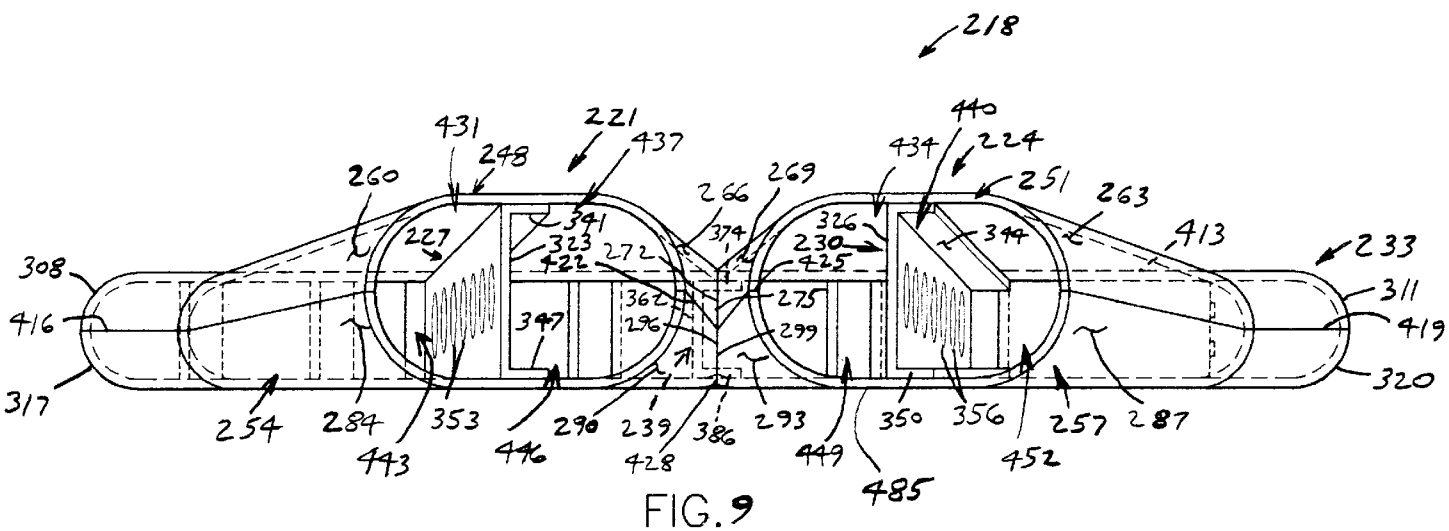
Figure 10:
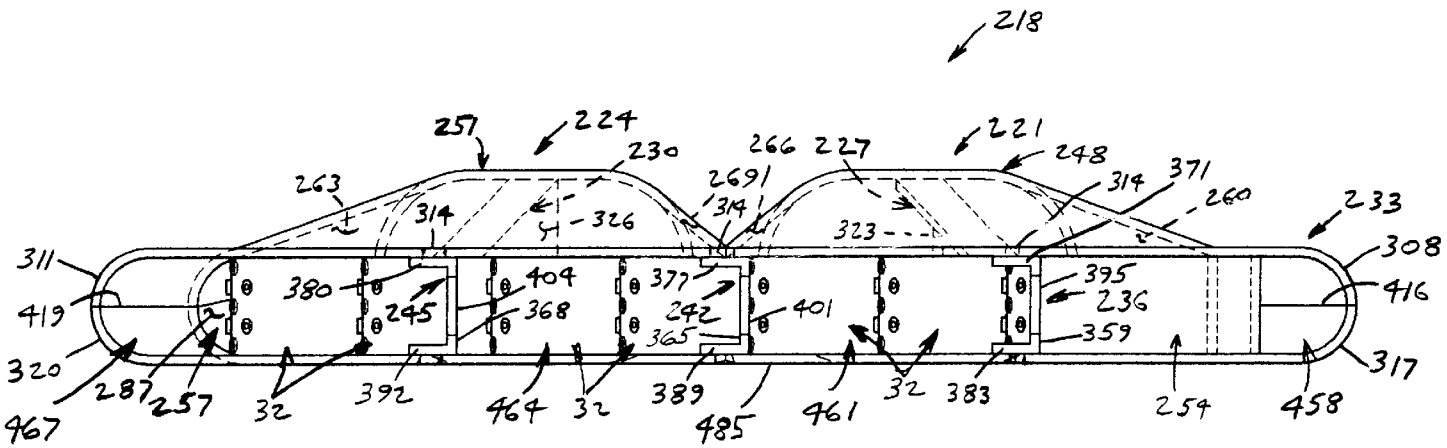
Figure 14:
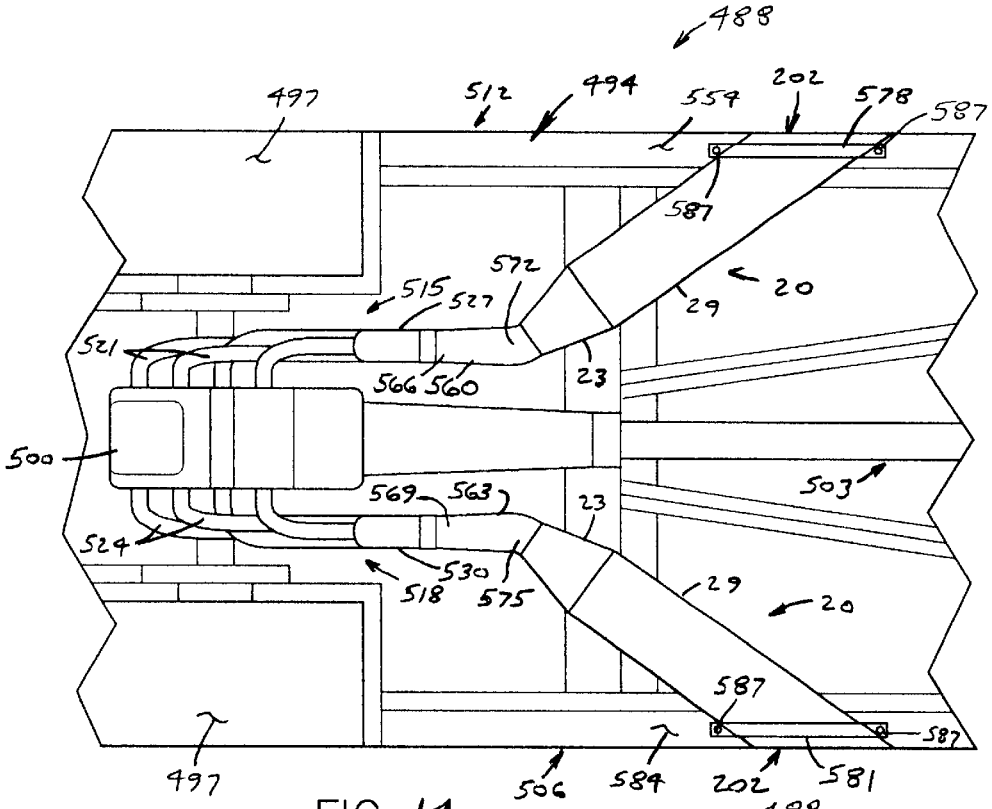
Figure 13:
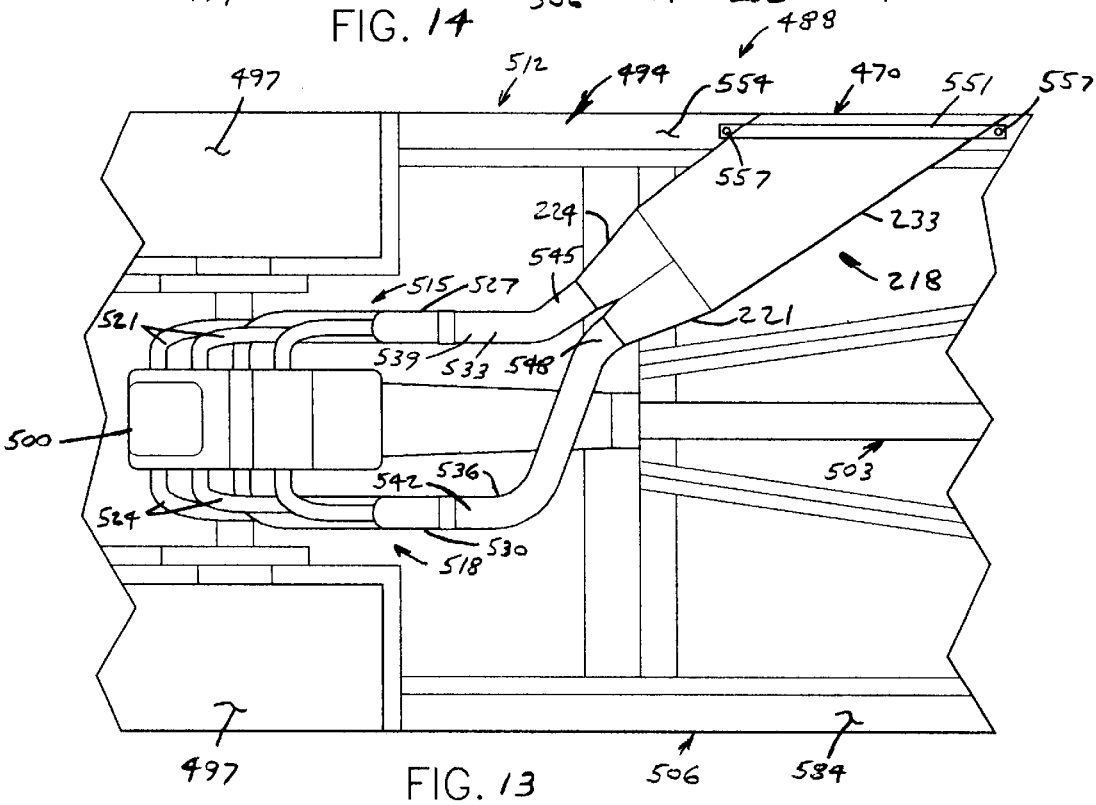

The best mode presently contemplated for carrying out the invention is illustrated in the accompanying drawings, in which:

FIG. 1 is a right front perspective view of a first embodiment acoustic muffler exhaust pipe of the invention which has a single tubular inlet having a single structural rib, and a tubular body with a plurality of acoustic traps and structural ribs therein;

FIG. 2, a top plan view, with the top portion broken away, of such first embodiment acoustic muffler exhaust pipe;

FIG. 3, a front elevational view taken on the line 3—3 of FIG. 2 showing the relative cross-sections of such first embodiment acoustic muffler exhaust pipe;

FIG. 4, a rear elevational view taken on the line 4—4 of FIG. 2 showing the relative cross-sections of such first embodiment acoustic muffler exhaust pipe;

FIG. 5A, a longitudinal vertical sectional view taken on the line 5—5 of FIG. 2 showing the front portion of such first embodiment acoustic muffler exhaust pipe, including the structural rib in the tubular inlet, and the structural ribs and spiral acoustic traps in the tubular body;

FIG. 5B, a longitudinal vertical sectional view taken on the line 5—5 of FIG. 2 showing the rear portion of such first embodiment acoustic muffler exhaust pipe including the structural ribs in the tubular body;

FIG. 6, a perspective view of a spiral acoustic trap as used in all embodiments of the acoustic muffler exhaust pipes;

FIG. 7, a fragmentary right front perspective view of a second embodiment acoustic muffler exhaust pipe of the invention which has a pair of tubular inlets each having a single structural rib which extends into the tubular body, and a tubular body with a plurality of acoustic traps and additional structural ribs therein;

FIG. 8, a top plan view, with the top portion broken away, of such second embodiment acoustic muffler exhaust pipe;

FIG. 9, a front elevational view taken on the line 9—9 of FIG. 8 showing the relative cross-sections of such second embodiment acoustic muffler exhaust pipe;

FIG. 10, a rear elevational view taken on the line 10—10 of FIG. 8 showing the relative cross-sections of such second embodiment acoustic muffler exhaust pipe;

FIG. 11A, a longitudinal vertical sectional view taken on the line 11—11 of FIG. 8 showing the front portion of such second embodiment acoustic muffler exhaust pipe, including the structural rib in the tubular inlet, and the structural ribs in the tubular body;

FIG. 11B, a longitudinal vertical sectional view taken on the line 11—11 of FIG. 8 showing the rear portion of such second embodiment acoustic muffler exhaust pipe, including the structural ribs and spiral acoustic traps in the tubular body;

FIG. 12, a side elevational view of a race car having an eight cylinder engine and which has such first embodiment acoustic muffler exhaust pipe mounted thereto;

FIG. 13, a fragmentary bottom plan view of such race car taken on the line 13—13 of FIG. 12 showing the header assemblies and secondary exhaust pipes connected to the first embodiment acoustic muffler exhaust pipe, the mounting thereof to the chassis of the car, with a portion thereof trimmed off to fit the exterior of the car; and FIG. 14, a fragmentary bottom plan view of such race car corresponding to FIG. 13 showing the header assemblies and secondary exhaust pipes connected to a pair of the second embodiment acoustic muffler exhaust pipes, the mounting thereof to the chassis of the car, with the portion of each thereof trimmed off to fit the exterior of the car.

DETAILED DESCRIPTION OF THE ILLUSTRATED EMBODIMENTS

The invention provides an acoustic muffler having a superior acoustic attenuation and gas flow rate compared to back pressure. This is accomplished by utilizing spiral shaped acoustic traps to perform a circular mixing process to portions of the inlet gas entering the muffler, the main gas flow, and by utilizing a venturi effect created by another portion of the inlet gas flow, the peripheral gas flow, to help remove the mixed main flow gas, in the form of an inner chamber gas flow, from the acoustic traps. The acoustic muffler of the invention is of simple, light weight, yet durable design and construction, which may be economically fabricated entirely from sheet metal components, or from other materials.

Referring to FIGS. 1–5, therein is shown a first embodiment, single inlet acoustic muffler exhaust pipe 20 comprising an exhaust gas tubular inlet 23 with a structural rib 26, and a tubular body 29 with a plurality of spiral acoustic traps 32 and structural ribs 35, 38, 41, and 44. Inlet 23 comprises an upper front half shell 47 and a lower front half shell 50. Upper front half shell 47 is a single piece of formed sheet metal of a raised, half oval shape having downwardly rounded outside edge portions 53 and 56. A plurality of holes such as round plug weld holes 59 extend longitudinally along the center of upper front half shell 47. Lower front half shell 50 is a single piece of formed sheet metal of a half oval shape having upwardly rounded outside edge portions 62 and 65. A plurality of plug weld holes such as round plug weld holes (not shown) extend longitudinally along the center of lower front half shell 50. Body 29 comprises an upper rear half shell 68 and a lower rear half shell 71. Upper rear half shell 68 is a single piece of formed sheet metal of a tapered, flattened shape having downwardly rounded outside edge portions 74 and 77. A plurality of plug weld holes such as plug weld slots 80 extend longitudinally along the center of upper rear half shell 68. Lower rear half shell 71 is a single piece of formed sheet metal of a tapered, flattened shape having upwardly rounded outside edge portions 83 and 86. A plurality of plug weld holes such as plug weld slots (not shown) extend longitudinally along the center of lower rear half shell 71. Structural rib 26 is a single piece of sheet metal having a C-shaped channel cross-section, with a tapered web 89 interconnecting an upper leg or flange 92 and a lower leg or flange 95 thereof. A plurality of round exhaust gas cross-over holes 98 extend through web 89. Exhaust gas cross-over holes 98, as well as any of the other exhaust gas cross-over holes used elsewhere, can be of other than round configuration such as those mentioned in my U.S. patent application Ser. No. 09/392,398, now U.S. Pat. No. 6,283.162. Structural ribs 35, 38, 41, and 44 are each a single piece of sheet metal having a C-shaped channel cross-section, with respective webs 101, 104, 107, and 110 interconnecting respective upper legs or flanges 113, 116, 119, and 122 and respective lower legs or flanges 125, 128, 131, and 134 thereof. A plurality of round exhaust gas cross-over holes 137, 140, 143, and 146 extend through respective webs 101, 104, 107, and 110.

In FIG. 6 is shown spiral acoustic trap 32, which is made from a single rectangular piece of sheet metal, preferably fourteen gauge to twenty gauge, in which a series of vents or outlets 149 are punched. The spiral shape of spiral acoustic trap 32 is created when the sheet of metal is bent, slightly more than one turn, into a spiral shape around a central axis 152 to form a spiral wall 155. The vents 149 shown are dimpled or frustoconical in shape, such that exhaust gasses are funneled into each vent 149 so as to pass more easily in the direction the dimples or cones point. There may be one, two, three, or more columns of vents 149, with alternate columns having vents aligned or staggered, with a variety of other arrangements possible. While vents 149 are shown in three columns which extend most of the height of acoustic trap 32, and are of an outwardly extending dimpled shape in this particular embodiment, other configurations and other suitable arrangements of vents are also possible as described in my U.S. patent application Ser. No. 09/392,398.

Upper and lower front half shells 47 and 50, upper and lower rear half shells 68 and 71, spiral acoustic traps 32, and structural ribs 26, 35, 38, 41, and 44 are arranged as best shown in FIGS 1 and 2. Acoustic muffler exhaust pipe 20 utilizes a single diagonally disposed linear group of spiral acoustic traps 32, though other arrangements are possible, positioned between structural ribs 35, 41, 44, and 38, which span between upper and lower rear half shells 68 and 71 with central axis 152 thereof substantially perpendicularly oriented thereto, and which are affixed thereto such as by a plurality of welds (not shown) or by brazing. A trap entrance opening 158 is formed by ends 161 and 164 of spiral acoustic trap 32 being offset, with the entrance opening 158 leading to an inner chamber 167 formed by spiral wall 155 of acoustic trap 32 and the upper and lower rear half shells 68 and 71 of tubular body 29. Successive acoustic traps 32 are staggered such as by about half the width of an acoustic trap 32. A lateral circumferential weld seam 170, a pair of longitudinal outside weld seams 173 and 176, and a plurality of plug welds (not shown) in the respective plug weld holes including round plug weld holes 59 and plug weld slots 80 secure spiral acoustic traps 32, structural ribs 26, 35, 38, 41, and 44, upper and lower front half shells 47 and 50, and upper and lower rear half shells 68 and 71 together as acoustic muffler exhaust pipe 20.

Exhaust gases enter exhaust pipe 20 through an oval shaped inlet opening 179 of tubular inlet 23 formed by upper and lower front half shells 47 and 50 into a main funnel passageway 182 formed thereby having a pair of individual passageways 185 and 188 interconnected by exhaust gas cross-over holes 98. Inlet 23 is typically secured such as by clamping or welding to an exhaust header assembly, secondary exhaust pipe, or Y-pipe (not shown) so as to receive exhaust gasses from an internal combustion engine (not shown) through inlet opening 179. Such exhaust gasses continue on into a main mixing passageway 191 formed by upper and lower rear half shells 68 and 71 having individual passageways 194, 197, and 200 interconnected by the respective exhaust gas cross-over holes 137, 140, 143, and 146 through structural ribs 35, 38, 41, and 44. Exhaust gas cross-over holes 137, 140, 143, and 146 extending through webs 101, 104, 107, and 110 of structural ribs 26, 35, 38, 41, and 44 allow the exhaust gasses in individual passageways 185 and 188 of main funnel passageway 182 and in individual passageways 194, 197, and 200 of main mixing passageway 192 to mix or combine and expand prior to exiting through a flattened outlet opening 202 of tubular body 29.

An inlet exhaust gas flow 203 enters through inlet opening 179 and flows into tubular body 29, splitting into a main exhaust gas flow 206 and a peripheral exhaust gas flow 209. A deflector plate or metering screen (not shown) can be included which spans between the first acoustic trap 32 of the group thereof and the adjacent side of tubular body 29 so as to regulate the volume and pressure of peripheral gas flow 209 relative to main exhaust gas flow 206. The entrance openings 158 of acoustic traps 32 extend into the main exhaust gas flow 206 so as to divert a portion of such gas flow and the accompanying sound waves into inner chamber 167 thereof. The entrance openings 158 of successive acoustic traps 32 are offset in the main exhaust gas flow 206 so as to assure that all of acoustic traps 32 receive an adequate flow of exhaust gasses. A space 212 between the last acoustic trap 32 of the group and the opposite adjacent side of tubular body 29 allows some of main gas flow 206 to bypass the entrance opening 158 of such last acoustic trap 32 so as to maintain a smooth main gas flow 206. Alternatively, the entrance openings 158 of the group of acoustic traps 32 can completely overlap main exhaust gas flow 206 so as to effectively divert the majority of main exhaust gas flow 206 into acoustic traps 32.

A bottom surface 215 of acoustic muffler exhaust pipe 20 lies in a plane "A" with upper and lower front half shells 47 and 50 angled upwardly so as to provide extra ground clearance. Upper and lower front half shells 47 and 50, upper and lower rear half shells 68 and 71, and structural ribs 26, 35, 38, 41, and 44 are typically made of sheet metal such as mild steel, stainless steel, or aluminum which is punched out of a sheet of metal and formed using a break or other comparable press.

Referring to FIGS. 7–11, therein is shown a second embodiment, dual inlet acoustic muffler exhaust pipe 218 comprising a pair of exhaust gas tubular inlets 221 and 224 with a pair of structural ribs 227 and 230, and a tubular body 233 with a plurality of spiral acoustic traps 32 and structural ribs 236, 239, 242, and 245. Tubular inlets 221 and 224 comprise respective upper front half shells 248 and 251 and respective lower front half shells 254 and 257. Upper front half shells 248 and 251 each are a single piece of formed sheet metal of a raised, half oval shape having respective downwardly rounded outside edge portions 260 and 263, and respective downwardly rounded inside edge portions 266 and 269 which are truncated at respective edges 272 and 275 so as to fit together. A plurality of round plug weld holes 278 and 281 extend longitudinally along the respective upper front half shells 248 and 251. Lower front half shells 254 and 257 each are a single piece of formed sheet metal of a raised, half oval shape having respective upwardly rounded outside edge portions 284 and 287, and respective upwardly rounded inside edge portions 290 and 293 which are truncated at respective edges 296 and 299 so as to fit together. A plurality of round plug weld holes (not shown) extend longitudinally along the respective lower front half shells 254 and 257. Tubular body 233 comprises an upper rear half shell 302 and a lower rear half shell 305. Upper rear half shell 302 is a single piece of formed sheet metal of a tapered, flattened shape having downwardly rounded outside edge portions 308 and 311. A plurality of plug weld holes such as plug weld slots 314 extend longitudinally along upper rear half shell 302 in three rows. Lower rear half shell 305 is a single piece of formed sheet metal of a tapered, flattened shape having upwardly rounded outside edge portions 317 and 320. A plurality of plug weld holes such as plug weld slots (not shown) extend longitudinally along lower rear half shell 305 in three rows. Each structural rib 227 and 230 is a single piece of sheet metal having a C-shaped cross-section, with respective webs 323 and 326 having respective tapered exhaust gas inlet sections 329 and 332, and respective generally untapered mixing sections 335 and 338 interconnecting respective bent upper legs or flanges 341 and 344, and respective straight lower legs or flanges 347 and 350 thereof. A plurality of respective round exhaust gas cross-over holes 353 and 356 extend through respective webs 323 and 326. Structural ribs 236, 239, 242, and 245 are each a single piece of sheet metal having a C-shaped channel cross-section, with respective webs 359, 362, 365, and 368 interconnecting respective upper legs or flanges 371, 374, 377, and 380 and respective lower legs or flanges 383, 386, 389, and 392 thereof. A plurality of round exhaust gas cross-over holes 395, 398, 401, and 404 extend through respective webs 359, 362, 365, and 368.

Upper and lower front half shells 248, 251, 254, and 257, upper and lower rear half shells 302 and 305, spiral acoustic traps 32, and structural ribs 227, 230, 236, 239, 242, and 245 are arranged as best shown in FIGS. 7 and 8. Acoustic muffler exhaust pipe 218 utilizes a single diagonally disposed linear group of spiral acoustic traps 32, though other arrangements are possible, positioned between structural ribs 227, 230, 236, 239, 242, and 245, which span between upper and lower rear half shells 302 and 305 with central axis 152 thereof substantially perpendicularly oriented thereto, and which are affixed thereto such as by a plurality of welds (not shown) or by brazing. A trap entrance opening 407 is formed by ends 161 and 164 of spiral acoustic trap 32 being offset, with the entrance opening 407 leading to an inner chamber 410 formed by spiral wall 155 of acoustic trap 32 and the upper and lower rear half shells 302 and 305 of tubular body 233. Successive acoustic traps 32 are staggered such as by about half the width of an acoustic trap 32. A lateral circumferential weld seam 413, a pair of outside weld seams 416 and 419, a pair of inside weld seams 422 and 425, a center weld seam 428, and plurality of plug welds (not shown) in the respective plug weld holes, including round plug weld holes 278 and 281, and plug weld slots 314, secure spiral acoustic traps 32, structural ribs 227, 230, 233, 236, 239, and 242, upper and lower front half shells 248, 251, 254, and 257, and upper and lower rear half shells 302 and 305 together as acoustic muffler exhaust pipe 218.

Exhaust gases enter exhaust pipe 218 through a pair of oval shaped inlet openings 431 and 434 of respective tubular inlets 221 and 224 formed by respective pairs of upper and lower front half shells 248 and 254, and 251 and 257 into respective main funnel passageways 437 and 440 formed thereby having pairs of individual passageways 443 and 446, and 449 and 452 interconnected by exhaust gas cross-over holes 353 and 356. Tubular inlets 221 and 224 are typically secured such as by clamping or welding to an exhaust header assembly or secondary exhaust pipes (not shown) so as to receive exhaust gasses from an internal combustion engine (not shown) through the respective inlet openings 431 and 434. Such exhaust gasses continue on into a main mixing passageway 455 formed by upper and lower rear half shells 302 and 305 having individual passageways 458, 461, 464, and 467 interconnected by the respective exhaust gas cross-over holes 353, 356, 395, 398, 401, and 404 through structural ribs 227, 230, 236, 239, 242, and 245. Exhaust gas cross-over holes 353, 356, 395, 398, 401, and 404 extending through webs 323, 326, 359, 362, 365, and 368 of structural ribs 227, 230, 236, 239, 242, and 245 allow the exhaust gasses in individual passageways 443, 446, 449, and 452 of main funnel passageways 437 and 440 and in individual passageways 458, 461, 464, and 467 of main mixing passageway 455 to mix or combine and expand prior to exiting through a flattened outlet opening 470 of tubular body 233.

An inlet exhaust gas flow 473 enters through inlet openings 431 and 434 and flows into tubular body 233, splitting into a main exhaust gas flow 476 and a peripheral exhaust gas flow 479. A deflector plate or metering screen (not shown) can be included which spans between the first acoustic trap 32 of the group thereof and the adjacent side of tubular body 233 so as to regulate the volume and pressure of peripheral gas flow 479 relative to main exhaust gas flow 476. The entrance openings 407 of acoustic traps 32 extend into the main exhaust gas flow 476 so as to divert a portion of such gas flow and the accompanying sound waves into inner chamber 410 thereof. The entrance openings 407 of successive acoustic traps 32 are offset in the main exhaust gas flow 476 so as to assure that all of acoustic traps 32 receive an adequate flow of exhaust gasses. A space 482 between the last acoustic trap 32 of the group and the opposite adjacent side of tubular body 233 allows some of main gas flow 476 to bypass the entrance opening 407 of such last acoustic trap 32 so as to maintain a smooth main exhaust gas flow 476. Alternatively, the entrance openings 407 of the group of acoustic traps 32 can completely overlap main exhaust gas flow 476 so as to effectively divert the majority of main exhaust gas flow 476 into acoustic traps 32.

A bottom surface 485 of acoustic muffler exhaust pipe 218 lies in a plane "B" with upper and lower front half shells 248 and 251 and 254 and 257 angled upwardly so as to provide extra ground clearance. Upper and lower front half shells 248 and 251 and 254 and 257, upper and lower rear half shells 302 and 305, and structural ribs 227, 230, 236, 239, 242, and 245 are typically made of sheet metal such as mild steel, stainless steel, or aluminum which is punched out of a sheet of metal and formed using a break or other comparable press.

Referring to FIGS. 12 and 13, therein is shown a typical installation of a dual inlet acoustic muffler exhaust pipe 218 to a race car comprising a stock car 488. Stock car 488 includes a body 491 mounted on or integral with a frame or chassis 494 with a plurality of wheels 497. An eight cylinder internal combustion engine 500 powers stockcar 488 through a drive train 503. Stock cars generally race on oval tracks in a counter-clockwise rotational direction leaning toward the outside of the turn, or the right side 506 of stock car 488. Therefore, the greatest clearance between chassis 494 of stock car 488 and the track or ground surface 509 results on the left side 512 of stock car 488. As such, exhaust pipe 218 is typically mounted to the left side 512 of stock car 488 under chassis 494. Exhaust gasses from engine 500 exit therefrom through a pair of left and right side headers 515 and 518 comprising a plurality of left and right side primary exhaust pipes 521 and 524 which merge into respective left and right side merge collectors 527 and 530. A pair of left and right side secondary exhaust pipes 533 and 536 are connected at respective ends 539 and 542 thereof to respective collectors 527 and 530 and at respective opposite ends 545 and 548 thereof to tubular inlets 221 and 224 of exhaust pipe 218 such as by means of clamping or welding. Tubular body 233 of exhaust pipe 218 is attached to chassis 494 of stock car 488 such as by means of a strap 551 which extends diagonally across tubular body 233 and attaches such as to a main member 554 of chassis 494 such as by means of a pair of bolts 557 disposed in a pair of threaded holes (not shown) therein. Exhaust pipe 218 is thus supported by secondary exhaust pipes 533 and 536 connected to respective headers 515 and 518 connected to engine 500, and by means of strap 551 immediately under chassis 494, and combined with a thin profile and flat bottom surface 485 provides maximum ground clearance "C" while maintaining an adequate cross-sectional area for exhaust gasses to exit through flattened outlet opening 470 so as to not create an unacceptable amount of exhaust gas back-pressure lowering the power output of engine 500. Tubular body 233 of exhaust pipe 218 is trimmed to fit the particular stock car 488. An optional H-pipe or exhaust gas crossover pipe (not shown) can be welded, or removably connected by means of welding standard fittings (not shown), to connect a pair of holes (not shown) one in the side of each of secondary exhaust pipes 533 and 536. The crossover pipe allows exhaust gasses to crossover between secondary exhaust pipes 533 and 536 to better balance the exhaust gas pressures therein during the firing of the cylinders of engine 500 dumping exhaust gasses alternately through headers 515 and 518 through respective secondary exhaust pipes 533 and 536 so as to reduce exhaust gas backpressure to engine 500 by allowing more efficient exiting of exhaust gasses. Note that in some situations the combination of ride height, type of track, and the design of the suspension and the stiffness thereof, the dual inlet acoustic muffler exhaust pipe 218 and secondary exhaust pipes 533 and 536 might be reversed such that dual inlet acoustic muffler exhaust pipe 218 exits from the right side 506 of stock car 488.

Referring to FIG. 14, therein is shown a typical installation of a pair of single inlet exhaust pipes 20 to the same stock car 488 having eight cylinder gasoline engine 500. While the greatest clearance between chassis 494 of stock car 488 and the ground surface 509 results on the left side 512 of stock car 488, it may be desirable on certain stock cars 488, for certain race tracks, or for certain races to use such dual exhaust pipes 20 which extend from both the right and left sides 506 and 512 under chassis 494 of stock car 488. Exhaust gasses from engine 500 exit therefrom through left and right side header assemblies 515 and 518. A pair of left and right side secondary exhaust pipes 560 and 563 are connected at respective ends 566 and 569 thereof to respective merge collectors 527 and 530 of header assemblies 515 and 518 and at respective opposite ends 572 and 575 thereof to tubular inlets 23 of respective exhaust pipes 20 such as by means of clamping or welding. Bodies 29 of respective exhaust pipes 20 are attached to chassis 494 of stock car 488 such as by means of straps 578 and 581 which extend diagonally across respective bodies 29 and attach such as to main member 554 and a main member 584, respectively, of chassis 494 such as by means of a pair of bolts 587 disposed in respective pairs of threaded holes (not shown) therein. Exhaust pipes 20 are thus supported by secondary exhaust pipes 563 and 566 by respective straps 578 and 581 immediately adjacent chassis 494 and combined with a thin profile and flat bottom surface 215 provides maximum ground clearance without an unacceptable amount of exhaust gas back-pressure. Bodies 29 of exhaust pipes 20 are trimmed to fit the particular stock car 488. An optional H-pipe or exhaust gas crossover pipe (not shown) can be welded, or removably connected by means of welding standard fittings (not shown), to connect a pair of holes (not shown) one in the side of each of secondary exhaust pipes 563 and 566. The crossover pipe allows exhaust gasses to crossover between secondary exhaust pipes 563 and 566 to better balance the exhaust gas pressures therein during the firing of the cylinders of engine 500 dumping exhaust gasses alternately through header assemblies 515 and 518 through respective secondary exhaust pipes 563 and 566 as to reduce exhaust gas backpressure to engine 500 by allowing more efficient exiting of exhaust gasses.

As indicated, an important feature of the acoustic muffler exhaust pipe is the thin profile thereof for increased ground clearance combined with the use of spiral acoustic traps wherein the main exhaust gas flow is established across the entrance openings of the spiral acoustic traps so that a substantial portion of the main exhaust gas flow is directed into the traps. Trap outlets allow gas directed into the traps to exit the spiral acoustic traps after flow into the traps so that gas flow through the traps is established. Various flow arrangements through the traps and through the mufflers may be used. While it is preferable that a venturi effect be created around the back side of the traps and that the trap outlets open into the area of low pressure created by this venturi effect since this promotes gas flow through the traps, the trap outlets may be differently positioned.

In summary, the acoustic muffler exhaust pipe of the invention provides reduced back pressure or conversely higher gas flow rates for a given acoustic attenuation resulting in higher acoustic efficiency while the thin profile thereof provides increased ground clearance. As stated previously, muffler acoustic efficiency is measured in decibels of noise attenuation (dba) versus gas flow rate in cubic feet per minute (CFM). As indicated, with a pressure difference of five inches of water across the muffler and standard 2½ inch diameter muffler inlet and outlet, a friction muffler has about 13–20 dba attenuation and about 70–100 CFM flow. Absorption type mufflers have about 2–7 dba attenuation and about 200 or more CFM gas flow. The muffler of the invention has about 8–15 dba with about 175 CFM gas flow.

While the embodiments of the muffler shown in the drawings have from four to seven spiral acoustic traps, any number of traps from one to eight or more may be used. The use of one acoustic trap provides some acoustic attenuation with three to seven acoustic traps providing the best acoustic attenuation. More than seven acoustic traps may be used, however, but with limited additional acoustic attenuation benefit.

The acoustic muffler exhaust pipes, the sheet metal construction thereof, exhaust systems which use the acoustic muffler exhaust pipes, and the method of constructing the acoustic muffler exhaust pipes, all comprise the inventive concept of the invention with many variations thereof possible while still staying within the overall inventive concept. Examples include, but are not limited to exhaust pipes constructed of a single sheet metal tube which is formed into the appropriately shaped inlet and body or constructed of separate inlet and body tubes which are formed and welded or clamped together, such forming being done such as by forcing appropriately shaped internal arbors or dies into the ends thereof such as by using a hydraulic press, and/or by using appropriately shaped external dies and forms. The inlets and bodies can be a single thin casting or separate castings welded, bolted, or otherwise connected together and can contain one or more ribs such as flat plate ribs or extruded metal ribs of a C-shaped channel cross-section, Z-shaped cross-section or other such cross-section. The sheet metal versions can have peripheral welds which are metal inert Gas (MIG), tungsten inert gas (TIG), stick, or otherwise welded together in a continuous or intermittent weld. Likewise, the sheet metal versions can be spot welded together at the joints of the half shells and the ribs, and at the outer periphery of the half shells if modified to include outwardly extending flanges which are spot welded together rather than having peripheral welds which are otherwise welded. While the structural rib typically extends into an inlet so as to provide a stronger structure for the boom tube exhaust pipe, such rib does not necessarily need to do so. Likewise, the portion of the structural rib which extends into an inlet need not be vertically tapered and can be affixed to only an upper or lower inside surface of the inlet, such rib being less costly to manufacture than a tapered rib yet providing some additional support to the inlet. The structural ribs provide support to the sheet metal half shells so as to minimize metal fatigue and subsequent exhaust pipe failure due thereto. While the exhaust pipes are typically made of mild steel or stainless steel, other metals such as aluminum can be used. Likewise, the half shells can be made of composite materials of resin and cloth which are laid up in an appropriately shaped mold, and the ribs comprise pultrusions of a composite material of resin and cloth. Such composite parts can be coated with a heat reflective metal sheeting or sprayed such as with an alumina slurry to form a solid ceramic alumina coating to lower the temperature to which the composite material is subjected. Likewise, metal components can be coated such as with the ceramic alumina to shield the metal from the heat and to keep the floor-board and driver's compartment of the car cooler for driver comfort. Metal ribs can be made of several individual pieces such as of sheared or punched sheet metal, or extruded metal which is welded, riveted, bolted, or otherwise connected together. The exhaust cross-over holes can be of the same size or of varying size such as along the tapered portion of web of the rib. The half shells can be asymmetrical in cross-section, have overlapping lateral or longitudinal edges, be left and right halves rather than upper and lower halves, be made of a single stamp formed piece of sheet metal which includes halves of the inlet and body together, include integrally stamp formed ribs therein which can be spot welded to the mating half shell or mating ribs thereof which extend only part-way vertically through the body and/or inlet of the boom tube exhaust pipe. The dual inlets can be integrally formed together and with the body from a single piece half shell of sheet metal. Likewise, the dual inlets can be integrally formed from a single piece of sheet metal and the body from a separate piece of sheet metal, which pieces are welded together to form a single half shell. The tubular inlet and body can be fabricated from separate formed pieces of sheet metal which can be made to overlap at respective edges thereof and spot welded together. Mounting brackets such as made of metal can be welded, strapped, bolted, or otherwise affixed to the tubular inlet and/or body in place of or in addition to the mounting straps to mount the boom tube exhaust pipe to the frame or the chassis of the car such as by using bolts or other fasteners. Likewise, additional straps can be used or the straps moved to a different location. While the body of the boom tube exhaust pipe is typically flared laterally outwardly to allow the exhaust gasses to expand without decreasing ground clearance, the body can be flared in the vertical direction if desired or needed for the particular application. While the acoustic muffler exhaust pipe is constructed from upper and lower half shells, left and right half shells, half shells which are asymmetrical, or which individually cover more or less than half of the circumference of the completed exhaust pipe. The number and position of the spacer ribs can be modified as needed to provide the strength, and vibration and fatigue resistance as needed to suit the particular application. Likewise, the gage of sheet metal used can be matched to the particular application with lower skid plates added to protect vulnerable portions of the boom tube exhaust pipe from abrasion from contact with the race track and from damage due to contact with debris on the race track. Rods and other types of reinforcing members can span between the upper and the lower half shells in addition to or in place of the ribs in certain applications of the acoustic muffler exhaust pipe. The spiral acoustic traps can be made of two or more separate curved pieces of sheet metal which interact to form a central chamber into which the main flow of exhaust gasses is directed into a spiral, with one or more of such curved plates having the vent holes therethrough.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An acoustic muffler exhaust pipe for attachment to the end of a secondary exhaust pipe leading exhaust gasses from the engine of a motor vehicle to attenuate acoustic noise in the exhaust gas flow, which boom tube exhaust pipe mounts to the bottom portion of the frame or chassis of the motor vehicle, and which provides improved ground clearance between the exhaust pipe and the surface of the ground, comprising:

a tubular inlet having a first end of mating configuration for attachment to the secondary exhaust pipe with an inlet opening for receiving exhaust gasses therefrom, the tubular inlet tapering from said first end to a generally flattened second end;

a tubular body of generally flattened shape corresponding to said second end of said tubular inlet, which extends therefrom and which terminates at an outlet opening for expelling the exhaust gasses into the atmosphere, whereby exhaust gas flows in said tubular inlet and body from said first end of said tubular inlet to said outlet opening of said tubular body;

a plurality of spiral acoustic traps formed by spiral trap walls disposed in said tubular body, spanning between a pair of opposing top and bottom walls of said tubular body, and having a central axis substantially perpendicular to the general direction of the exhaust gas flow, each spiral having an entrance opening into the exhaust gas flow and a back side substantially opposite said entrance, with that of the exhaust gas flow which flows across said entrance openings comprising a main gas flow, and the remaining gas flow which passes on the back side comprising a peripheral gas flow; and wherein there are a plurality of vents through said trap wall of each of said acoustic traps, said vents positioned on the back side of said trap such that the peripheral gas flow forms a low pressure zone at said vents, due to a venturi effect created by the peripheral gas flow passing through a narrowed area between said outside of said trap and an adjacent wall, so as to draw gas from the inside of said trap through said vents.

2. An acoustic muffler exhaust pipe according to claim 1, wherein the inlet opening is of a somewhat flattened circular shape for attachment to a comparably configured secondary exhaust pipe.

3. An acoustic muffler exhaust pipe according to claim 1, wherein the body is flared laterally outwardly in a generally horizontal plane from the tubular inlet to the outlet opening so as to allow the exhaust gasses to expand moving through said body.

4. An acoustic muffler exhaust pipe according to claim 1, wherein the flattened body includes a bottom surface lying generally in a plane and the inlet includes a bottom surface which lies at or above said lower plane in a mounted position on the motor vehicle.

5. An acoustic muffler exhaust pipe according to claim 4, wherein the inlet opening is of a flattened circular shape for attachment to a comparably configured secondary exhaust pipe.

6. An acoustic muffler exhaust pipe according to claim 1, further comprising a structural rib which extends generally longitudinally through at least a portion of the body and which vertically spans between and is affixed to said body juxtaposed an upper and a lower inside surface of said body so as to provide support therebetween.

7. An acoustic muffler exhaust pipe for attachment to the end of a secondary exhaust pipe leading exhaust gasses from the engine of a motor vehicle to attenuate acoustic noise in the exhaust gas flow, which boom tube exhaust pipe mounts to the bottom portion of the frame or chassis of the motor vehicle, and which provides improved ground clearance between the exhaust pipe and the surface of the ground, comprising:

a tubular inlet having a first end of mating configuration for attachment to the secondary exhaust pipe with an inlet opening for receiving exhaust gasses therefrom, the tubular inlet tapering from said first end to a generally flattened second end:

a tubular body of generally flattened shape corresponding to said second end of said tubular inlet, which extends therefrom and which terminates at an outlet opening for expelling the exhaust gasses into the atmosphere, whereby exhaust gas flows in said tubular inlet and body from said first end of said tubular inlet to said outlet opening of said tubular body;

a structural rib is plug welded to the body through a plurality of plug weld holes in said body which extends generally longitudinally through at least a portion of the body and which vertically spans between and is affixed to said body juxtaposed an upper and a lower inside surface of said body so as to provide support therebetween;

a plurality of spiral acoustic traps formed by spiral trap walls disposed in said tubular body, spanning between a pair of opposing top and bottom walls of said tubular body, and having a central axis substantially perpendicular to the general direction of the exhaust gas flow, each spiral having an entrance opening into the exhaust gas flow and a back side substantially opposite said entrance, with that of the exhaust gas flow which flows across said entrance openings comprising a main gas flow, and the remaining gas flow which passes on the back side comprising a peripheral gas flow; and wherein there are a plurality of vents through said trap wall of each of said acoustic traps said vents positioned on the back side of said trap such that the peripheral gas flow forms a low pressure zone at said vents, due to a venturi effect created by the peripheral gas flow passing through a narrowed area between said outside of said trap and an adjacent wall, so as to draw gas from the inside of said trap through said vents.

8. An acoustic muffler exhaust pipe according to claim 6, wherein a plurality of holes extend through the structural rib to allow exhaust gasses to flow therethrough.

9. An acoustic muffler exhaust pipe according to claim 6, wherein the structural rib comprises a web which interconnects respective upper and lower flanges which extend generally laterally therefrom.

10. An acoustic muffler exhaust pipe for attachment to the end of a secondary exhaust pipe leading exhaust gasses from the engine of a motor vehicle to attenuate acoustic noise in the exhaust gas flow, which boom tube exhaust pipe mounts to the bottom portion of the frame or chassis of the motor vehicle, and which provides improved ground clearance between the exhaust pipe and the surface of the ground, comprising:

a tubular inlet having a first end of mating configuration for attachment to the secondary exhaust pipe with an inlet opening for receiving exhaust gasses therefrom, the tubular inlet tapering from said first end to a generally flattened second end;

a tubular body of generally flattened shape corresponding to said second end of said tubular inlet, which extends therefrom and which terminates at an outlet opening for expelling the exhaust gasses into the atmosphere, whereby exhaust gas flows in said tubular inlet and body from said first end of said tubular inlet to said outlet opening of said tubular body;

a structural rib which extends generally longitudinally through at least a portion of the body and which vertically spans between and is affixed to said body juxtaposed an upper and a lower inside surface of said body so as to provide support therebetween, and wherein the structural rib is generally laterally centered relative to the inlet and extends into said inlet to provide support therefor;

a plurality of spiral acoustic traps formed by spiral trap walls disposed in said tubular body, spanning between a pair of opposing top and bottom walls of said tubular body, and having a central axis substantially perpendicular to the general direction of the exhaust gas flow, each spiral having an entrance opening into the exhaust gas flow and a back side substantially opposite said entrance, with that of the exhaust gas flow which flows across said entrance openings comprising a main gas flow, and the remaining gas flow which passes on the back side comprising a peripheral gas flow; and wherein there are a plurality of vents through said trap wall of each of said acoustic traps, said vents positioned on the back side of said trap such that the peripheral gas flow forms a low pressure zone at said vents, due to a venturi effect created by the peripheral gas flow passing through a narrowed area between said outside of said trap and an adjacent wall, so as to draw gas from the inside of said trap through said vents.

11. An acoustic muffler exhaust pipe according to claim 10, wherein the portion of the structural rib which extends into the inlet is tapered so as to span between and is affixed to said inlet juxtaposed an upper and a lower inside surface of said inlet so as to provide support therebetween.

12. An acoustic muffler exhaust pipe for attachment to the end of a secondary exhaust pipe leading exhaust gasses from the engine of a motor vehicle to attenuate acoustic noise in the exhaust gas flow, which boom tube exhaust pipe mounts to the bottom portion of the frame or chassis of the motor vehicle, and which provides improved ground clearance between the exhaust pipe and the surface of the ground, comprising:

a tubular inlet having a first end of mating configuration for attachment to the secondary exhaust pipe with an inlet opening for receiving exhaust gasses therefrom, the tubular inlet tapering from said first end to a generally flattened second end;

a second inlet laterally adjacent the first inlet and having a first end of mating configuration for attachment to a second secondary exhaust pipe with an inlet opening for receiving exhaust gasses therefrom, the tubular inlet tapering from said first end to a second generally flattened end;

a tubular body of generally flattened shape corresponding to said second ends of said tubular inlets, which extends therefrom and which terminates at an outlet opening for expelling the exhaust gasses into the atmosphere, whereby exhaust gas flows in said tubular inlet and body from said first end of said tubular inlet to said outlet opening of said tubular body;

a plurality of spiral acoustic traps formed by spiral trap walls disposed in said tubular body, spanning between a pair of opposing top and bottom walls of said tubular body, and having a central axis substantially perpendicular to the general direction of the exhaust gas flow, each spiral having an entrance opening into the exhaust gas flow and a back side substantially opposite said entrance, with that of the exhaust gas flow which flows across said entrance openings comprising a main gas flow, and the remaining gas flow which passes on the back side comprising a peripheral gas flow; and wherein there are a plurality of vents through said trap wall of each of said acoustic traps, said vents positioned on the back side of said trap such that the peripheral gas flow forms a low pressure zone at said vents, due to a venturi effect created by the peripheral gas flow passing through a narrowed area between said outside of said trap and an adjacent wall, so as to draw gas from the inside of said trap through said vents.

13. An acoustic muffler exhaust pipe according to claim 12, wherein the inlet opening is of a somewhat flattened circular shape.

14. An acoustic muffler exhaust pipe according to claim 12, wherein the body is flared laterally outwardly in a generally horizontal plane from the tubular inlets to the outlet opening so as to allow the exhaust gasses to expand moving through said body.

15. An acoustic muffler exhaust pipe according to claim 12, wherein the flattened body includes a bottom surface lying generally in a plane and each inlet includes a bottom surface which lies at or above said lower plane in a mounted position on the motor vehicle.

16. An acoustic muffler exhaust pipe according to claim 15, wherein the inlet openings are of a somewhat flattened circular shape for attachment to respective comparably configured secondary exhaust pipes.

17. An acoustic muffler exhaust pipe according to claim 12, further comprising a structural rib which extends generally longitudinally through at least a portion of the body and which vertically spans between and is affixed to said body juxtaposed an upper and a lower inside surface of said body so as to provide support therebetween.

18. An acoustic muffler exhaust pipe according to claim 17, further including a second structural rib of similar construction to the first structural rib, wherein each structural rib is generally laterally centered relative to a respective inlet and extends into the respective inlet to provide support therefor.

19. An acoustic muffler exhaust pipe for attachment to the end of a secondary exhaust pipe leading exhaust gasses from the engine of a motor vehicle to attenuate acoustic noise in the exhaust gas flow, which boom tube exhaust pipe mounts to the bottom portion of the frame or chassis of the motor vehicle, and which provides improved around clearance between the exhaust pipe and the surface of the ground, comprising:

a tubular inlet having a first end of mating configuration for attachment to the secondary exhaust pipe with an inlet opening for receiving exhaust gasses therefrom, the tubular inlet tapering from said first end to a generally flattened second end;

a tubular body of generally flattened shape corresponding to said second end of said tubular inlet, which extends therefrom and which terminates at an outlet opening for expelling the exhaust gasses into the atmosphere, whereby exhaust gas flows in said tubular inlet and body from said first end of said tubular inlet to said outlet opening of said tubular body, wherein the inlet and body comprise a pair of sheet metal half shells which are welded together at respective outside seams;

a metal structural rib which extends generally longitudinally through the body and which vertically spans between and is welded to said body juxtaposed an upper and a lower inside surface of said body so as to provide support therebetween;

a plurality of spiral acoustic traps formed by spiral trap walls disposed in said tubular body, spanning between a pair of opposing top and bottom walls of said tubular body, and having a central axis substantially perpendicular to the general direction of the exhaust gas flow, each spiral having an entrance opening into the exhaust gas flow and a back side substantially opposite said entrance, with that of the exhaust gas flow which flows across said entrance openings comprising a main gas flow, and the remaining gas flow which passes on the back side comprising a peripheral gas flow; and wherein there are a plurality of vents through said trap wall of each of said acoustic traps, said vents positioned on the back side of said trap such that the peripheral gas flow forms a low pressure zone at said vents, due to a venturi effect created by the peripheral gas flow passing through a narrowed area between said outside of said trap and an adjacent wall, so as to draw gas from the inside of said trap through said vents.

20. An acoustic muffler exhaust pipe according to claim 19, wherein the structural rib is plug welded to the body through a plurality of plug weld holes in said body.

21. An acoustic muffler exhaust pipe according to claim 19, wherein the structural rib comprises a piece of sheet metal having a web which interconnects respective laterally outwardly bent upper and lower flanges which extend generally normally therefrom.

22. An acoustic muffler exhaust pipe according to claim 21, wherein the structural rib is of generally C-shaped channel cross-section.

23. An acoustic muffler exhaust pipe according to claim 21, wherein a plurality of holes extend through the structural rib to allow exhaust gasses to flow therethrough.

24. An acoustic muffler exhaust pipe according to claim 21, wherein the structural rib is generally laterally centered relative to the inlet and extends into said inlet to provide support therefor.

25. An acoustic muffler exhaust pipe according to claim 24, wherein the portion of the structural rib which extends into the inlet is tapered so as to span between and is affixed to said inlet juxtaposed an upper and a lower inside surface of said inlet so as to provide support therebetween.

26. An acoustic muffler exhaust pipe according to claim 19, wherein the half shells comprise respective upper and lower half shells.

27. An acoustic muffler exhaust pipe according to claim 26, wherein each of the upper and lower half shells comprise inlet and body halves which are welded together.

28. An acoustic muffler exhaust pipe according to claim 21, wherein the half shells comprise respective upper and lower half shells, the inlet and the body each include a bottom surface with the bottom surface of the inlet lying at or above a lower plane of the bottom surface of the body in a mounted position on the motor vehicle, and wherein the structural rib extends into the inlet to provide support therefor with the portion of said structural rib which extends into said inlet being tapered so as to span between and is affixed to said inlet juxtaposed an upper and a lower inside surface of said inlet so as to provide support therebetween.

29. An acoustic muffler exhaust pipe according to claim 28, wherein the inlet opening is of a somewhat flattened circular shape.

30. An acoustic muffler exhaust pipe according to claim 29, wherein each of the upper and lower half shells comprise inlet and body halves which are welded together.

31. An acoustic muffler exhaust pipe according to claim 30, wherein the structural rib is of generally C-shaped channel cross-section.

32. An acoustic muffler exhaust pipe according to claim 31, wherein the structural rib is plug welded to the inlet and body halves through a plurality of plug weld holes in said inlet and body halves.

33. An acoustic muffler exhaust pipe according to claim 28, further comprising:

a second inlet laterally adjacent the first inlet and having a first end of mating configuration for attachment to a second secondary exhaust pipe with an inlet opening for receiving exhaust gasses therefrom, the tubular inlet tapering from said first end to a second generally flattened end with the tubular body which extends from both inlets and terminates at an outlet opening for expelling the exhaust gasses into the atmosphere; and a second structural rib of the same construction as the first structural rib which extends generally longitudinally through the body and substantially into the inlet to provide support therefor, said second structural rib being generally laterally centered relative to said second inlet and which vertically spans between and is affixed to said body juxtaposed an upper and a lower inside surface of said body and wherein the portion of said second structural rib which extends into the inlet is tapered so as to span between and is affixed to said inlet juxtaposed an upper and a lower inside surface of said inlet so as to provide support therebetween.

34. An acoustic muffler exhaust pipe according to claim 33, further comprising a center spacer rib which extends substantially the length of the body generally laterally centered therein between the respective inlets.

35. An acoustic muffler exhaust pipe according to claim 34, wherein the inlet openings are of a somewhat flattened circular shape.

36. An acoustic muffler exhaust pipe according to claim 35, wherein each of the upper and lower half shells comprise inlet and body halves which are welded together.

37. An acoustic muffler exhaust pipe according to claim 36, wherein the inlet halves of the upper and lower half shells are vertically cut so as to mate together laterally and welded at a periphery between the inlets halves of the upper and lower half shells.

38. An acoustic muffler exhaust pipe according to claim 36, wherein the structural ribs and spacer rib are of generally C-shaped channel cross-section.

39. An acoustic muffler exhaust pipe according to claim 38, wherein the structural ribs and the spacer rib are plug welded to the inlet and body halves through a plurality of plug weld holes in said inlet and body halves.

40. An acoustic muffler exhaust pipe according to claim 34, further comprising a pair of lateral spacer ribs which extend generally longitudinally through the body each being disposed laterally outside one of the respective structural ribs.

41. An acoustic muffler exhaust pipe according to claim 40, wherein the inlet openings are of a somewhat flattened circular shape.

42. An acoustic muffler exhaust pipe according to claim 41, wherein each of the upper and lower half shells comprise inlet and body halves which are welded together.

43. An acoustic muffler exhaust pipe according to claim 42, wherein the inlet halves of the upper and lower half shells are vertically cut so as to mate together laterally and welded at a periphery between the inlets halves of the upper and lower half shells.

44. An acoustic muffler exhaust pipe according to claim 42, wherein the structural ribs and the spacer ribs are of generally C-shaped channel cross-section.

45. An acoustic muffler exhaust pipe according to claim 44, wherein the structural ribs and the spacer ribs are plug welded to the inlet and body halves through a plurality of plug weld holes in said inlet and body holes.

* * * * *